US005611312A

United States Patent [19]

Swanson et al.

[11] Patent Number: 5,611,312

[45] Date of Patent: Mar. 18, 1997

[54] CARBURETOR AND METHOD AND APPARATUS FOR CONTROLLING AIR/FUEL RATIO OF SAME

[75] Inventors: Mark S. Swanson, Cass City; Eric L. King, Deford, both of Mich.

[73] Assignee: Walbro Corporation, Cass City, Mich.

[21] Appl. No.: 384,860

[22] Filed: Feb. 7, 1995

[51] Int. Cl.[6] ..... F02M 1/02; F02M 7/20

[52] U.S. Cl. ..... 123/436; 123/438; 123/179.18; 261/52

[58] Field of Search ..... 123/438, 687, 123/699, 701, 179.18, 436; 261/35, 52, DIG. 68, 64.6

[56] References Cited

U.S. PATENT DOCUMENTS

| | | | |
|---|---|---|---|
| 2,160,411 | 5/1939 | Blattner et al. | 261/52 |
| 4,123,480 | 10/1978 | Johansson | 261/52 |
| 4,349,877 | 9/1982 | Oyama et al. | 123/438 |
| 4,617,892 | 10/1986 | Staerzl | 123/352 |
| 4,949,692 | 8/1990 | Devine | 123/687 |
| 5,069,180 | 12/1991 | Schmidt et al. | 123/179.18 |
| 5,200,118 | 4/1993 | Hermle | 261/64.6 |
| 5,226,920 | 7/1993 | Andreasson | 123/436 |
| 5,250,233 | 10/1993 | Swanson | 261/34.2 |
| 5,284,113 | 2/1994 | Svensson | 123/344 |
| 5,345,912 | 9/1994 | Svensson et al. | 123/438 |
| 5,500,159 | 3/1996 | Martinsson | 261/52 |

FOREIGN PATENT DOCUMENTS 4411634 10/1995 Germany .

*Primary Examiner*—Andrew M. Dolinar

*Attorney, Agent, or Firm*—Barnes, Kisselle, Raisch, Choate, Whittemore & Hulbert

[57] ABSTRACT

A small engine carburetor with manually controlled choke and throttle valves and associated idle ports and main metering nozzle supplied with fuel from a common metering chamber. The A/F is automatically adjusted by a solenoid operated poppet valve and/or gear driven needle valve and cooperative electronic control circuitry and system components built-in to the carburetor. A combined accelerator pump and idle circuit shut-off mechanism is also built-in and mechanically operated by the throttle shaft so that only the main nozzle supplies fuel when the engine is running above fast idle. A mechanical choke/throttle interlock mechanism also prevents partial choking when the engine is running above fast idle, and throttle operation above fast idle when choking. An electric motor worm gear drive unit controlled by the automatic system is detachably coupled to, and provides fine incremental adjustment of, the main metering needle and is self-locking to retain set adjustment during engine running and at engine shut-off. Control system components are arranged in a compact overall package characterized by a laterally offset, skewed orientation of control box and carburetor body, with a diaphragm fuel pump and metering chamber sharing box and body for intercooling of electronic and electrical components by incoming fuel while assisting fuel vaporization in the carburetor venturi passage.

45 Claims, 7 Drawing Sheets

CARBURETOR AND METHOD AND APPARATUS FOR CONTROLLING AIR/FUEL RATIO OF SAME

FIELD OF THE INVENTION

This invention relates to engine fuel systems, and more particularly to gasoline carburetors for internal combustion engines.

BACKGROUND OF THE INVENTION

In all internal combustion (i.c.) engines the so-called air/fuel ratio (A/F) is of great importance to the function of the engine. To obtain a proper combination of low fuel consumption, low exhaust gas emissions, good operability and high power the A/F must be kept within relatively close limits. As a rule, an A/F slightly to the lean side of the optimal power value is preferred (so-called "lean burn").

In present day high cost, sophisticated internal combustion engines, such as provided in automobiles, the problem of A/F mixture variations has been largely overcome due to the relatively recent developments in electronic fuel injection systems. Typically, such automotive fuel systems employ an electro-mechanical fuel pump delivering fuel at relatively high pressure to a solenoid-type electrically controlled and actuated fuel metering valve which is computer operated in accordance with a complex system. Many parameters of engine operation and ambient conditions are sensed continuously, and these monitored parameters are fed to an electronic processing system to control the fuel metering valve in accordance with the resultant matrix of such parameters. Again, however, the cost, complexity, bulk and reliability of such fuel injection systems is such to make the same highly impractical for use in the field of small single or dual cylinder engines such as used on chain saws, weed whips, lawn mowers, garden tractors and other small lawn, garden and forestry appliances.

In addition, small carburetors that are used in chain saws and other small engines have been decreasing in size because of the demands for smaller units to fit within all hand-held chain saws. There has also been pressure on the manufacturers of carburetors to reduce the cost of these carburetors because of the keen competition in the field. It is also desirable that servicing of the carburetors be accomplished in as expedient a manner as possible and that the number of parts in the carburetors be reduced. These factors further mitigate against use of such known prior art solutions.

Accordingly, carburetors still remain the only practical choice for gasoline fuel feeding to such small engines wherein the fuel flow to the fuel supply opening in the carburetor throat is controlled by a needle valve. Typically such carburetors are provided with a main adjustment orifice to control the main fuel supply, and an idle adjustment orifice and associated needle valve to control supply of fuel to the idle circuit located downstream of the main fuel jet in the vicinity of the throttle valve of the carburetor.

Future legal restrictions on emissions of CO will not allow manual adjustment of the carburetor. With the tolerances of manufacture of the carburetor that can be obtained it is not possible by using fixed nozzles in the carburetor to both fulfill the aforementioned legal restrictions and simultaneously assure the engine/appliance operator a good operability at all combinations of air pressure, temperature, varying fuel quality, etc. The preferred A/F is normally influenced by a number of factors. Some of these are known when the engine is designed and can therefore be corrected from the beginning, but others depend on variations of external circumstances such as air pressure, temperature, fuel quality, variations connected with the manufacture of the carburetor, and last but not least, the manner in which the carburetor engine choke and throttle controls are manually manipulated by the operator of the engine-equipped appliance.

Certain i.c. engines, such as the aforementioned automotive engines, have been provided with special oxygen sensors or lambda sondes in the exhaust system. It is thereby possible to sense engine combustion performance and the sonde measurements can be used in a self-adaptive closed loop control system to control the A/F in order to provide a good result under all conditions on a "real time" basis. However, this is an expensive and complicated control system which for reasons of cost and operational reliability can hardly be used in the aforementioned small engine consumer products such as chain saws, lawn mowers, etc.

According to present techniques used for adjusting the carburetor, the operator adjusts the carburetor manually at full throttle to obtain a recommended maximum speed of rotation. This technique is unsatisfactory to meet even the wider emission tolerances to be allowed for small engines since it does not ensure in any way that the contents of HC and CO are kept within prescribed limits. As indicated previously, products such as chain saws, lawn mowers, clearing saws, etc., require low manufacturing cost due to the low price of such consumer products. Nevertheless, due to advances and cost reductions in solid-state microcomputer electronics in the last few decades low cost solid-state magnet-type ignition systems are now customarily provided which operate without the generator or alternator of automotive systems and which provide a ready source of low wattage power and engine speed (tachometer) signals.

The availability of such solid-state ignition systems has enabled some of the foregoing problems as they relate to carburetors designed for small engines to be generally addressed by provision of an A/F control system, apparatus and method as set forth in U.S. Pat. Nos. 5,226,920; 5,284,113; and 5,345,912, which are incorporated herein by reference. As pointed out in the '920 patent, it was previously known to detect small variations in engine speed from one revolution to another by electronic means connected to a magnetic ignition system in which the signal generated by the ignition flywheel magnet in the primary or charging winding is used for measuring the speed of the engine by measuring the period of time between pulses. This method is very accurate in detecting even small speed variations and also provides a rapid response.

The '920 patent provides an A/F control system which combines the electronics of the ignition system with an electrically adjustable carburetor fuel system and comprises an electronic detector and control unit which uses a portion of the energy of the ignition magnet for feeding current to the electronic equipment so that no extra generator or battery is required. This system also includes a electronic data processing means, an electronic memory and an electromechanical control unit for adjusting the A/F. This adjustment is performed after a period of time during which the speed of the engine has been generally constant. The parameter used for adjustment is the first derivative of engine RPM. A basic reference value is established on the given engine measurements in the laboratory and stored in the memory of the control system.

The generally constant engine speed is detected by calculating the average value of the first derivative of the engine speed function, the speed of revolution of the engine being considered to be generally constant when the average value of the first derivative is approximately zero. The system adjusts the A/F step wise or successively when the engine is operating under load until the first derivative of speed variations has reached a predetermined level, or a break point of lean adjustment as detected as a function of a reduction of the speed revolution of the engine. If the measured discrete absolute value of the first derivative of engine speed variation when averaged exceeds a reference value measured in the laboratory, the system determines that the air/fuel mixture is too lean. The A/F mixture is then adjusted richer in steps of about 4% until the average value of the first derivative is close to the reference value. In this manner the air/fuel ratio of the engine is adjusted with regard to a previously known speed dependency of the A/F to provide a modified speed dependency of the ratio preferably approaching a constant A/F over the operational speed range of the engine. Although the '920 patent states generally that the adjustment to A/F is carried out by a micro computer which controls drive circuits of an electric motor connected to the fuel nozzle of the carburetor of the engine whereby various adjustments can be made to the fuel nozzle by the computer, no such fuel nozzle control mechanism is otherwise shown or described.

The '912 patent adds a second A/F control system and means for adjusting the A/F based on actual operating conditions using a feedback system which takes all variations into account affecting the A/F at the time of sensing. A fuel needle is provided for A/F testing which is actuated between open and closed positions by a solenoid valve to thereby open and close a secondary or by-pass flow path to the main fuel nozzle of the carburetor. When this by-pass path is closed the secondary flow is shut-off while the primary flow continues, thereby reducing total fuel flow to the main fuel nozzle and thus changing the A/F to a leaner mixture for a short period of time. The change of speed of rotation on the engine occurring in response to this leaning of the A/F mixture is measured to determine whether the A/F in existence prior to the shut-off adjustment test is a leaner or richer mixture compared to a preferred level or optimum point in the engine power curve. The A/F is then adjusted by a predetermined step towards the preferred level by actuating an A/F adjusting means, such as by modulating the air pressure differentials acting on the diaphragm of the carburetor. It is to be noted that the '912 patent also suggests that, instead of controlling the reference pressure in the diaphragm air chamber, one or two fuel nozzles could be controlled by a throttle needle in the main throttle flow and controlled proportionately by an electric motor. However, such an alternative is neither shown nor further described.

The test procedure is repeated by the second control circuit until the change of engine RPM indicates that the mixture ratio is at the preferred level. This adjustment is then maintained for a period of time after which the second or test control circuit resumes the testing and adjustment of the mixture ratio.

The periodical testing in which the solenoid needle is actuated to close the secondary fuel feed to temporarily lean out the mixture must be of as short a duration as possible so that the engine user is generally unaware of the test procedure taking place. This test control circuit can thereby provide A/F correction for a plurality of disturbances to which the engine might be exposed, such as variations of air pressure and temperature, fuel type and quality as well as defects in the manufacture of the carburetor such as tolerance variations.

Other strategies for adjusting and/or controlling an electrically adjustable carburetor are set forth in the published European patent application Publication No. 0 297 670 A2 published Jan. 4, 1989 and in U.S. Pat. Nos. 4,617,892; 4,949,692 and 5,284,113. In the first three of these approaches, the absolute value of engine speed is utilized rather than the first derivative of speed variations of the engine. In EPA 0 297 670 A2, a control unit develops a control signal for a stepper type motor having a pinion gear on its output shaft engaging a rack teeth on a rod to rotate a threaded fuel needle to thereby control flow through a fuel nozzle to thereby vary the air/fuel ratio delivered by the carburetor to the engine.

As shown semi-schematically and briefly described in U.S. Pat. No. 5,284,113, an externally mounted electric motor 16 rotates an angled gear 17 on a shaft 14 threadably engaged in a carburetor housing bore 18 and having a fuel flow adjusting needle 12 at its inner end, which can be made as a self-braking screw to maintain the adjusted needle setting when the engine is shut off. However, no disclosure is provided as to how such a needle drive is to be constructed and integrated into the carburetor structure in a practical manner. In U.S. Pat. No. 4,617,892 no fuel flow controlling devices are shown and are merely stated generally to be a fuel injection system or a carburetor with electrically controllable metering. U.S. Pat. No. 4,949,692 references generally an electronic fuel metering valve not otherwise shown or described, or an electrical flow controller (EFC) such as that manufactured by Borg-Warner Corporation, U.S.A. said to operate as a variable orifice which responds to a digital pulse width modulated electrical signal at a fixed frequency. Again, only a schematic showing is provided without any disclosure of how such adjustable fuel flow devices are to be constructed and/or manufactured nor economically integrated into a small engine diaphragm carburetor in a practical manner.

Although the method of controlling a carburetor with electrically controllable metering in accordance with the previously discussed '912 patent has been deemed to be one preferable approach with respect to the problems associated with controlling A/F ratio in small engine diaphragm carburetors, attempts to implement this method in practical devices has led to the discovery of several additional problems needing solution. In order to obtain simplicity and reduce costs in this type of carburetor it would be desirable to eliminate, for regulation of the A/F mixture, the added external equipment associated with the vacuum pump and vacuum line connected to the air chamber of the diaphragm carburetor as set forth in the '912 patent. Also limitations of the '912 patent "test-adjust-repeat" fuel control mechanism also inherently makes it difficult to shorten the duration of each lean out phase of the test cycle so as to minimize interruption of the normal engine operating mode. It has been found that shutting off fuel flow through a second or tributary fuel path between the diaphragm fuel metering chamber and the main jet or nozzle does not adequately satisfy the need for a precisely controlled and short lean out time.

Additionally, the working environment for diaphragm carburetors on small engines subjects the carburetor and the automatic control components to severe vibrations, engine heat, rough handling and other adverse working conditions. These environmental conditions render reliable and repetitive automatic control mechanisms difficult to achieve in a practical and economical manner, particularly when attempting to finely adjust the A/F over a small range to optimize the proper combination of low fuel consumption, low exhaust gas emissions, good operability and high power.

Moreover, in order to adapt such electrical adjustment systems to conventional diaphragm carburetors for small engines, it is necessary to retain the conventional butterfly choke valve and idle fuel feed system customarily provided in such carburetors. This poses additional problems in attempting to implement the periodic test-lean-out-adjust control system of the '912 patent in practice. In conventional non-electrical small engine carburetors utilizing a flexible diaphragm for regulation of fuel flow to both the main and idling nozzles or orifices, when the engine is operating at wide open throttle the fuel bleeds or is removed from the idle circuit of the carburetor. Consequently, when the engine goes from full throttle to idle, it frequently stumbles and sometimes stalls because the idle circuit then supplies insufficient fuel to the engine. If the carburetor is automatically controlled such that the A/F is maintained on the lean-burn side, such as according to the automatic control system of the '912 patent, it has been found that this stumble and stall problem is aggravated because the mixture is already on the lean side. Furthermore, when operating at part throttle, the carburetor tends to supply a fuel mixture which is richer than the idler mixture for operation of the engine due to an adverse influence of continued fuel supply from the idle circuit of the carburetor, and which is not subject to automatic A/F control.

One solution to such problems as embodied in a non-electrical carburetor is set forth in U.S. Pat. No. 5,250,233 issued in the name of Mark S. Swanson and assigned to the assignee of record herein, which is incorporated herein by reference. In this invention a combination accelerator pump and shut off device is provided to control the fuel to the idle chamber. Preferably, the accelerator and shut off device is actuated by movement of the throttle from its idle position to initially supply a relatively small quantity of additional fuel for accelerating the engine, and to shut off the idle circuit under wide open throttle operating conditions. This prevents bleed back of fuel in the idle circuit so that when the throttle returns to its idle position and the shut off device opens, idle fuel remains available and thus is immediately supplied to the idle jet for operation of the engine under idle conditions. Moreover due to the "lost motion" between the piston and valve of the '233 patent mechanism, when the throttle is only partially opened the supply of fuel to the idle well and associated idle ports is shut off, thereby eliminating the influence of the idle circuit on the A/F mixture under engine partial load conditions so that the fuel mixture is determined solely by the main nozzle of the carburetor. It has been found that such problems as disclosed in the '233 patent with respect to a conventional non-electrical diaphragm carburetor are also present and even more severely impair electrically controlled fuel metering to optimize the A/F, particularly when utilizing the method and devices of the aforementioned '920 and '912 patents inasmuch as they control A/F adjustment by modulating fuel flow only to the main nozzle.

Additional problems in implementing electrically controllable metering in a small engine diaphragm carburetor have been found to arise from the need to retain manual control of both the choke and throttle valves, thereby allowing the uncontrollable variable of operator manual intervention in the control system to defeat the automatic system goals.

Of course, there are also the overriding problems associated with attempting incorporate the automatic system components into a low cost and compact carburetor package without unduly complicating the component design, increasing the cost of manufacture and assembly of the carburetor and sacrificing operational life and reliability as well as serviceability.

OBJECTS OF THE INVENTION

Accordingly an object of the present invention is to provide an improved carburetor and method and apparatus for controlling the same to more accurately and reliable automatically adjust the A/F of the engine associated with the carburetor to a preferred level, and capable of efficiently utilizing the method and system of the aforementioned '920 and '912 patents in whole or in part as well as other prior art electrically controlled fuel metering strategies and systems.

Another object of the present invention is to provide an improved carburetor of the aforementioned character and associated automatic A/F control system and apparatus which facilitates acceleration of an engine from its idle condition, substantially eliminates momentary hesitation and stumbling of the engine as it rapidly accelerates from its idle condition, eliminates stumbling and stalling of the engine during rapid deceleration from its wide open throttle to idle operating conditions, while enabling the engine to run on an A/F adjusted to the lean side of optimum, decreases carbon monoxide and other engine exhaust emissions, provides a more desirable A/F and mixture during engine part throttle operating conditions, is of relatively simple design and economical manufacture and assembly and has a long useful life in service.

A further object is to provide a carburetor and a method and apparatus for controlling the same automatically which is highly accurate and stable in operation, adapted to withstand the severe adverse conditions of small engine working environments such as heavy engine vibrations and heat from air-cooled single cylinder engines, which provides consistent and stable and long life operational control of A/F adjustments, which is compact and rugged in construction and operation which enables a rapid test-measure-adjust cycle well adapted to perform the method of the '912 patent and/or the '920 patent in an improved manner thereover.

Yet another object is to provide in a diaphragm or float-type carburetor a mechanical system combinable with an automatic electronically controlled fuel metering system which prevents impairment or defeat of the automatic system by improper operator manipulation of the manual choke and throttle controls.

SUMMARY OF TEE INVENTION

A small engine carburetor with manually controlled choke and throttle valves and associated idle jets and main metering nozzle supplied with fuel from a common metering chamber, and in which the A/F is automatically adjusted by a solenoid operated poppet valve and/or gear driven needle valve and cooperative electronic control circuitry and system components built-in to the carburetor. A combined accelerator pump and idle jet shut-off mechanism is also built-in and mechanically operated by the throttle shaft so that only the main nozzle supplies fuel when the engine is running above fast idle to thereby improve engine operation and assist proper automatic electric A/F adjustment control. A mechanical choke/throttle interlock mechanism also prevents partial choking, and throttle operation when choking, when the engine is running above fast idle, thereby further assisting electric A/F control and/or damage to a catalytic converter in the engine exhaust system. An electric motor worm gear drive unit controlled by the automatic system is detachably coupled to, and provides fine incremental adjustment of, the main metering needle and is self-locking to retain set adjustment at engine shut-off.

The cooperative electronic and mechanical control system components are arranged in a compact overall package characterized by a laterally offset, skewed orientation of control box and carburetor body, with a diaphragm fuel pump sharing box and body for intercooling of electronic and electrical components by incoming fuel while assisting fuel vaporization in the carburetor venturi passage.

BRIEF DESCRIPTION OF THE DRAWINGS

The foregoing as well as other objects, features and advantages of the present invention will become apparent from the following detailed description of the best mode, appended claims and accompanying drawings (which are to engineering design scale unless otherwise indicated) in which:

DETAILED DESCRIPTION OF THE PREFERRED EMBODIMENT

Basic Carburetor Structure and Operation

Figure 1:
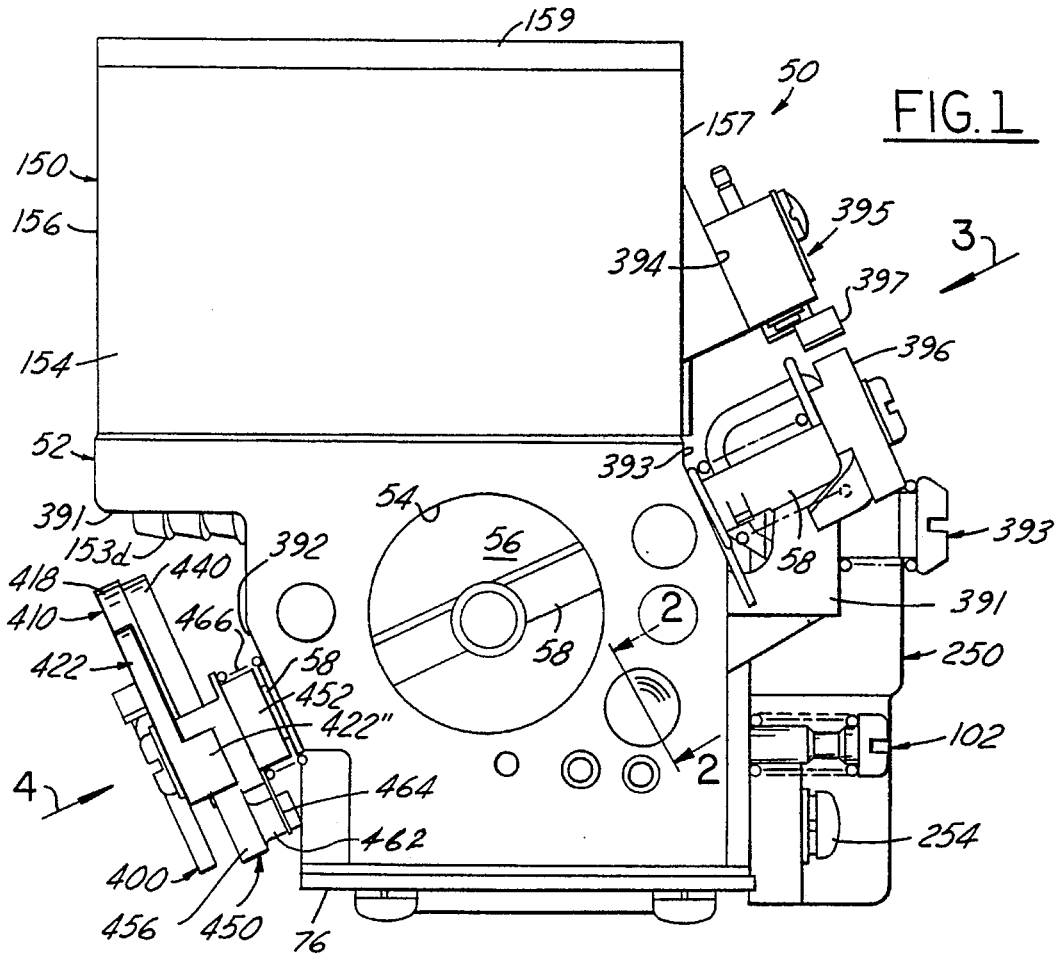
FIG. 1 is an end elevational view of the engine mounting rear end face of a carburetor embodying this invention.
Figure 4:
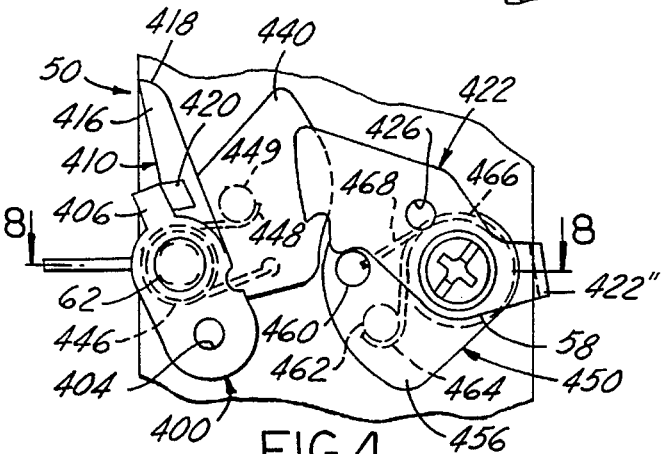
FIG. 4 is a fragmentary side elevational view of a portion of the lower left hand side of the carburetor as viewed in FIG. 1 looking in the direction of the arrow 4 of FIG. 1.
Figures 5, 6, 7, 8:
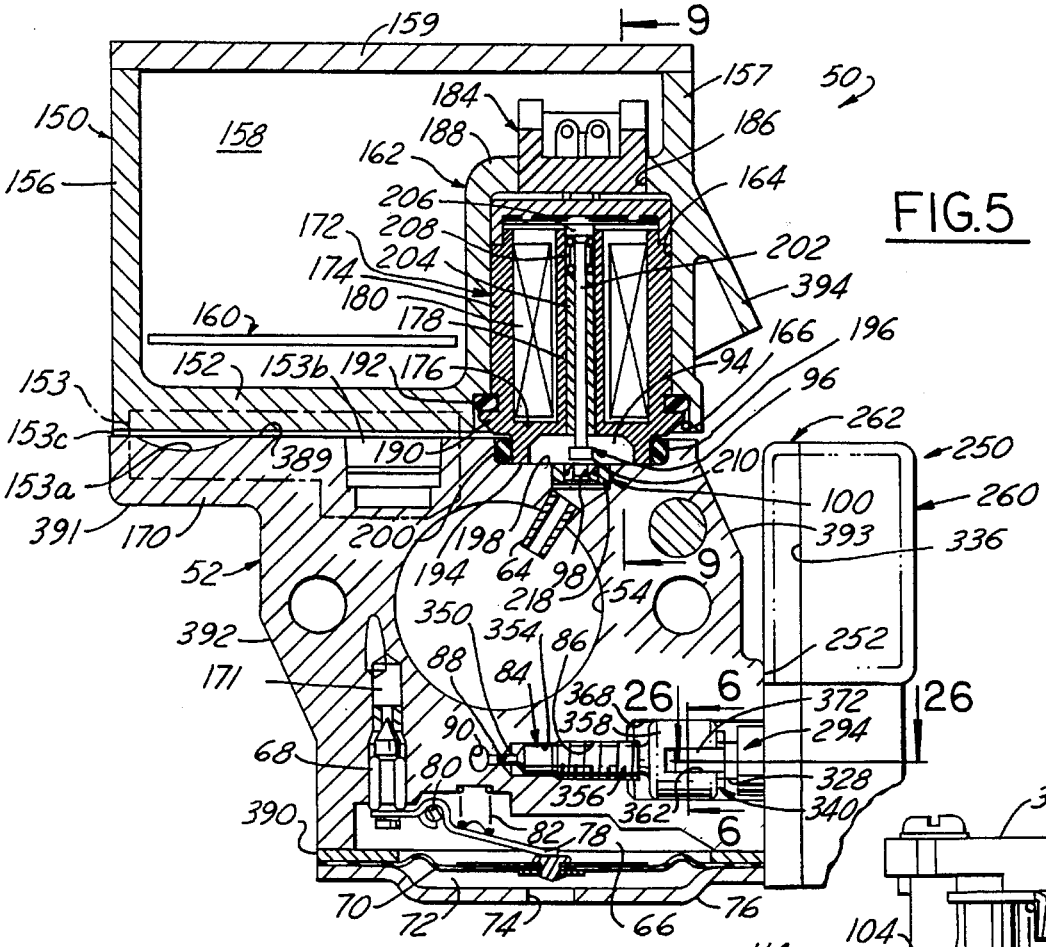
FIG. 5 is a vertical cross-sectional view of the carburetor of FIG. 1 taken on the line 5—5 of FIG. 10 but with a gear motor drive unit shown in elevation.
FIG. 6 is a center cross-sectional view taken along the line 6—6 of FIG. 5 and enlarged thereover.
FIG. 7 is a cross-sectional view of the valve seat associated with the main fuel shut-off test device of the invention shown by itself and enlarged over the showing thereof in FIG. 5.
FIG. 8 is a cross-sectional view taken on the line 8—8 of FIG. 4.

FIGS. 1, 5, 8 and 10 are assembly views illustrating a diaphragm carburetor 50 embodying this invention comprising a cast and machined aluminum body 52 having a straight through central venturi passage 54 in which a throttle valve plate 56 (FIGS. 1 and 8) is operably disposed and mounted on a throttle shaft 58. The throttle valve is movable from its closed, normal (low) idle position as shown in FIGS. 1 and 8 to a wide open throttle position (shown in FIG. 35) by rotating shaft 58 clockwise as shown in FIGS. 4 and 8 so that throttle plate 56 is disposed substantially parallel to the direction of flow of air through the venturi (arrow A in FIGS. 8 and 10). Preferably a choke valve plate 60 mounted on a choke shaft 62 (FIGS. 8 and 10) is also disposed in the venturi passage upstream of the throttle valve. In use, carburetor 50 is mounted on an intake manifold or crankcase of an engine so that atmospheric air will be drawn by engine intake suction through venturi passage 54 in the direction of arrow A to aspirate an air and fuel mixture into the engine.

Figure 9:
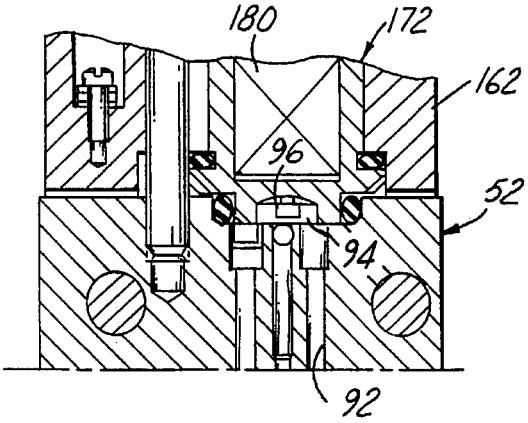
FIG. 9 is a fragmentary cross-sectional view taken on the line 9—9 of FIG. 5.

Fuel is supplied to a main metering nozzle tube 64 (FIG. 5) from a metering chamber 66 formed in the bottom of carburetor body 52. In operation, fuel in the metering chamber is maintained at a substantially constant sub-atmospheric pressure by a metering chamber inlet valve 68 actuated by a diaphragm 70. The upper face of diaphragm 70 (as viewed in FIG. 5) communicates with metering chamber 66 and its underface with an air chamber 72 in turn communicating with atmosphere via an opening 74 in a diaphragm chamber cover plate 76. Inlet valve 68 is operably connected to diaphragm 70 by a lever arm 78 pivoted on a pin 80 and biased by a spring 82. The quantity of fuel supplied to main nozzle 64 can be varied and automatically adjusted within predetermined limits by a high speed mixture needle valve 84 threadably received in a passage 86 in body 52. The free, needle end of valve 84 variable restricts fuel flow past passage seat 88 in flow communication on its upstream side with metering chamber 66 via a body passage (not shown), and on its downstream side with a body passage 90. Passage 90 communicates with main nozzle 64 via a body passage 92 (FIG. 9) leading to a valve chamber 94 in which a poppet valve 96 is disposed, as described in more detail hereinafter. Chamber 94 communicates via a passage 98 of a valve seat insert 100 with main jet nozzle 64 (FIG. 5).

Figure 3:
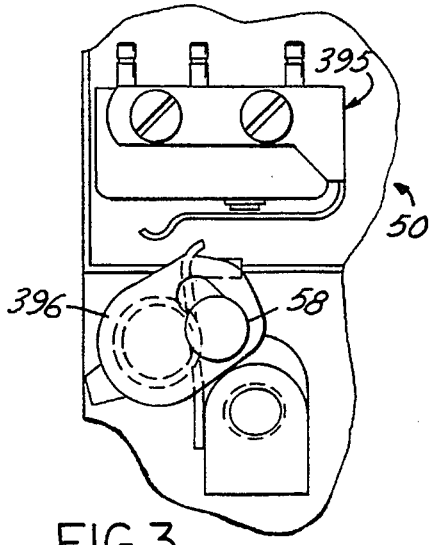
FIG. 3 is a fragmentary elevational view of a portion of the upper right hand side of the carburetor as viewed in FIG. 1 looking in the direction of the arrow 3 of FIG. 1.

Similarly, fuel is supplied from metering chamber 66 to an idle fuel pocket or well 101 and associated idle ports 101*a*, 101*b*, 101*c* and 101*d* (FIG. 34) provided in carburetor body 52 in a conventional manner and constructed and operably arranged in association with throttle plate 56 in the manner disclosed in the aforementioned Swanson patent 5,250,233, which is incorporated herein by reference (see in particular FIG. 3 of the '233 patent and associated description). The quantity of fuel normally supplied to the idle pocket 101 and associated idle ports from the metering chamber can be varied and adjusted within predetermined limits by a conventional idle adjustment needle valve assembly 102 (FIGS. 1 and 10) received in a threaded passage (not shown) and cooperating with an associated passage seat in communication with the metering chamber 66 through an associated body passage port (not shown) and corresponding to needle valve 52 of the '233 patent.

Accelerator Pump and Shut-Off Device

In accordance with one feature of this invention, automatic electric carburetor 50 is preferably provided with the accelerator pump and shut-off device referenced as 60 in the '233 patent which controls the quantity of fuel supplied to the idling well ports under various operating conditions. The low speed circuit of carburetor 50 is thus made inoperable by opening throttle valve 56 to a predetermined angular opening. Hence in this condition fuel is only allowed to discharge from the high speed circuit via nozzle 64, shut-off device 60 thereby insuring that during this operational period total fuel flow from the carburetor to the engine is controlled solely by the high speed mixture needle 84.

Figure 2:
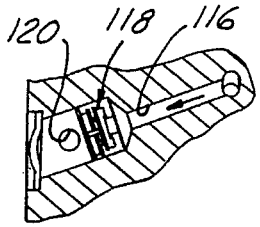
FIG. 2 is a fragmentary cross-sectional view taken on the line 2—2 of FIG. 1.

In carburetor 50 this shut-off device is generally referenced as 104 in FIG. 8 and corresponds to device 60 of the '233 patent. Shut-off device 104 thus has a piston 106 carrying an O-ring 107, valve 108, spring 110, O-ring valve seat 112 and inlet passage 114 (FIG. 8), and an associated outlet passage 116 (FIG. 2), back check valve assembly 118 therein and downstream passage 120 leading to the idle well 101 and corresponding to like structure functioning as described and claimed in the aforementioned Swanson '233 patent. Likewise throttle shaft 58 is provided with a notch to define a cam face 122 (FIG. 8) against which the head 124 of piston 106 is abuttingly biased by spring 110.

Figure 34:
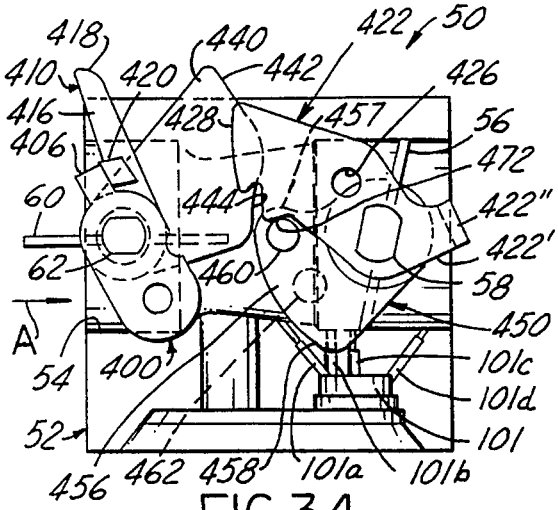
Figure 35:
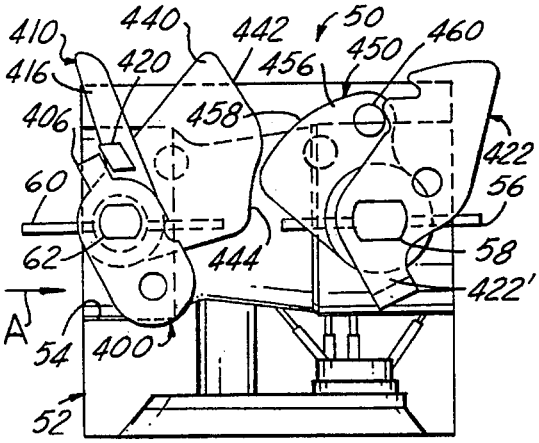
Figure 36:
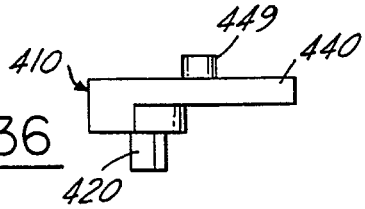
FIGS. 36, 37, 38 and 39 are respectively a plan view (FIG. 36), side elevational view (FIG. 37), reverse side elevational view (FIG. 38), and an end elevational view (FIG. 39) of the fast idle lock lever of the choke throttle lock-out mechanism shown by itself on a reduced scale relative to FIGS. 33–35.

Thus as throttle shaft 58 is rotated to move throttle plate 56 from the normal idle position shown in FIGS. 1, 8 and 34 to the wide open throttle position shown in FIG. 35, cam 122 advances piston 106 and associated valve 108 so that the tip of valve 108 bears on O-ring seat 112, 114 to thereby shut-off flow of fuel from metering chamber 66. When valve 108 is open, fuel normally flows from chamber 66 via inlet passage 114 through O-ring 112 into the chamber 126 defined between O-ring 112 and piston 106, and thence from chamber 126 through outlet passage 116, back check valve 118 and passage 120 to the idle well under the manually adjustable flow control of the idle adjustment needle valve assembly 102.

Further advancement of piston 106 by rotation of throttle shaft 58 also pumps a quantity of fuel from chamber 126 through idle well 101 and associated ports into the venturi passage 54 and thence into the engine intake manifold or crank case to provide fuel for accelerating the engine. As the engine accelerates, the air flow through venturi increases and thus fuel is supplied by aspiration through the main metering nozzle 64. Also, during such wide open throttle operation, valve 108 remains closed so that no additional fuel is supplied to the idle well. During wide open throttle operation of the engine, check valve 118 prevents any back-flow of fuel and any entrained air which would otherwise tend to flow from idle well toward chamber 126. This tendency for back-flow occurs in some engines and carburetors substantially immediately upon initial opening movement of throttle valve plate 56 away from its idle position, thereby causing a momentary reverse flow or back-flow of fuel from idle pocket 101 which adversely affects engine performance. Thus for such engines and carburetors, it is highly preferable to include check valve 118 because this momentary reverse flow would otherwise occur before shut-off valve 108 is closed by rotation of throttle shaft 58.

When the engine is rapidly decelerated from wide open throttle to idle conditions by rotation of throttle shaft 58 to the idle position corresponding rotation of cam face permits piston 106 to be rapidly retracted by the bias of compression spring 110. This both opens valve 108 and produces a pumping action tending to draw fuel from metering chamber 66 to fuel pump chamber 126 to more rapidly supply fuel to idle pocket 101 and associated idle ports for operation of the engine under idling conditions. As piston 106 is so spring retracted, check valve 118 insures that there is no reverse flow of fuel and entrained air from idle well 101 into pump chamber 126.

Due to the "lost motion" between piston 106 and valve 108, in accordance with this Swanson '233 patent feature, when throttle plate 56 is only partially opened, valve 108 bears on O-ring seat 112 and shuts off the supply of fuel to the idle well and associated idle ports, thereby eliminating the influence of the idle circuit on the A/F ratio or mixture under engine partial load conditions, so that the engine fuel mixture is determined solely by the output from main nozzle 64. Since shut-off and pump device 104 and check valve 118 and the associated idle well, idle ports idle needle valve metering and diaphragm are set forth in detail in the aforementioned Swanson '233 patent, they will not be described in further detail herein.

It has been found that in the A/F control system of the preferred embodiment of the present invention this feature is particularly important to assure the proper functioning of the automatic control of A/F ratio since it assures that the control of the total fuel flow during this operational period is solely under the influence of the adjustment of high speed mixture needle 84 and the associated poppet valve 96 disposed in downstream serial flow communication between valve 84 and nozzle 64, as will be explained in more detail subsequently herein.

Electrical System Control Box

In accordance with a further feature of the present invention, carburetor 50 is provided with a control box housing 150 (FIGS. 1, 5 and 10) which is mounted, on a suitable gasket, to the flat upper side of carburetor body 52 and has a flat bottom wall 152 which serves as the cover and chamber plate for generally one half of the structure of a conventional engine-pressure-pulse-operated diaphragm fuel pump 153, the remaining structure of pump 153 being provided in the upper regions of carburetor body 52. Pump 153 is otherwise of conventional construction and hence only schematically shown by the chain line in FIG. 5. However, a portion of the structure of pump 153 is shown structurally as indicated by the pump chambers 153*a* and 153*b* and gasket and flap valve/diaphragm 153*c* seen in FIG. 5, and by the fuel supply hose inlet nipple 153*d* partially seen in FIG. 1.

Housing 150 comprises a generally rectangular box-like structure preferably made as a casting and comprising a pair of laterally opposed side walls 154, 155 and longitudinally opposed end walls 156, 157 extending integrally upright from bottom wall 152 to thereby define an interior control box cavity 158. A cover plate 159 is removably fastened onto the upper edges of the housing walls 154–157 to seal off cavity 158 and provide assembly and service access thereto. An electronic detector and control unit (not shown) is mounted in housing cavity 158 includes conventional solid state electronic data processing means, electronic membrane memory and associated control unit components indicated schematically by the circuit board 160 shown in FIG. 5. One embodiment of such control system components usable in carburetor 50 is illustrated and described in the aforementioned U.S. Pat. Nos. 5,226,920 and/or 5,345,912, which are incorporated herein by reference and hence the details of their construction and operation will not be described in further detail herein.

Housing 150 also integrally incorporates a solenoid subhousing 162 (FIG. 5) interiorly adjacent and cast integrally with end wall 157 and side wall 155 of housing 150 and having a cylindrical bore 164 with its axis oriented coincident with that of the valve seat 100 and terminating at a larger diameter counterbore 166 at its lower end opening at the bottom face of bottom wall 152. It is to be understood that housing bottom wall 152 in the region thereof between subhousing 162 and the opposite end wall 156 is provided with suitable conventional cavities, passages, pumping diaphragm and flap valves which cooperate with corresponding passages, cavities, etc. in the flat upper wall 170 of carburetor body 152 to define a conventional crank case-pulse-actuated diaphragm fuel pump structure customarily provided in association with diaphragm-type carburetors, and hence not described in detail herein.

The bottom wall 152 of housing 150 thus provides roughly one-half of the diaphragm pump structure of carburetor 50, thereby serving the dual function of the pump cover chamber plate of a conventional carburetor as well as the bottom wall of the electronic component compartment 158. The incoming liquid fuel for the engine enters this region via nipple 153*d* generally at the ambient temperature of the appliance fuel tank and circulates in the diaphragm pump cavities provided in walls 152, and cavities such as 153*a* and 153*b* in body wall 170 before being delivered via the pump outlet body passageways (not shown) to chamber 171 upstream of to the inlet needle valve 68. This fuel circulation thus helps cool compartment 158 and helps extract heat from the electronic components operating therein, as well as heat generated by the operation of solenoid 172 received in bore 164. As the fuel absorbs such heat energy, its temperature is also raised, thereby assisting in fuel vaporization when it reaches venturi passage 54.

Solenoid 172 has a generally cylindrical outer casing 174 integrally joined by a bottom end wall 176 with a cylindrical inner wall 178 which serves as the electromagnetic core of the solenoid. The annular cavity between walls 174 and 178 receives an annular coil winding 180 of solenoid 172. An end cad 182 seats on a shoulder groove at the upper end of outer wall 174 to close the upper end of solenoid 172. A suitable electrical terminal block 184 mounts in a complimentary opening 186 provided in top wall 188 of subhousing 162. Solenoid 162 has an electrical terminal contacts which engage mating terminal contacts of block 184 (not shown). Suitable electrical connections are made within housing 150 between the components mounted on circuit board 160 and terminal block 182, and with the engine ignition magneto system in the manner described previously by electrical leads running externally of carburetor 50 (not shown), as will be those understood by those skilled in the art.

The lower end of solenoid housing wall 174 has an external flange 190 with a groove thereabove for receiving an O-ring 192 which sealably seats in bore 166 to prevent fuel leakage upwardly there past. Bottom end wall 176 has an annular rib 194 dependent therefrom encircled by an O-ring 196 to sealably seat the lower end of solenoid 172 in a circular cavity provided in the upper face 389 of carburetor body 52, this cavity being defined by a flat bottom wall 198 and a peripheral wall 200. Valve chamber 94 is thus defined between walls 176 and 198 and rib 194 and is sealed against leakage by O-ring 196.

Poppet valve 96 has a cylindrical stem 202 made of suitable aluminum to serve as the movable valve stem of solenoid 172. Stem 202 is slidably received in a bearing sleeve 204 in turn received within and affixed to the inner wall of core sleeve 178. The upper end of stem 202 has a cylindrical head 206 integrally affixed thereon which slides in core sleeve 178. A ferromagnetic armature disc 207 is swaged-fastened on head 206 and is electromagnetically reciprocated between upper end of casing 174 and an annular stop on underside of cap 182 to thereby likewise reciprocate valve 96. A compression coil spring 208 encircles stem 202 and bottoms at its upper and lower ends against the underside of head 206 and the upper edge of sleeve 204 respectively to thereby bias stem 202 upwardly to the valve-open position shown in FIG. 5. Valve 96 has a poppet head 210 in the form of a cylindrical disc fixed coaxially to the lower end of stem 202 and having a flat underface perpendicular to the stem axis adapted to sealably abut in closed position against the flat upper face 212 of an elastomeric valve seat annulus 214 of valve insert 100 (FIG. 7). Insert 100 also includes an annular retainer ring 216 which has a press fit in a drilled bore 218 in body 52 opening at its upper end to face 198. Seat 214 is held in ring 216 by an internal rib 220 seating in a peripheral groove provided in insert 214 (FIG. 7).

When solenoid 172 is energized to drive poppet valve 96 downwardly to closed position, fuel flowing past needle valve 84 to main nozzle 64 is cut-off, which thus shuts off all flow of fuel to venturi 54 via nozzle 64, and vice versa.

Worm Gear Drive for Needle Valve 84

Figure 10:
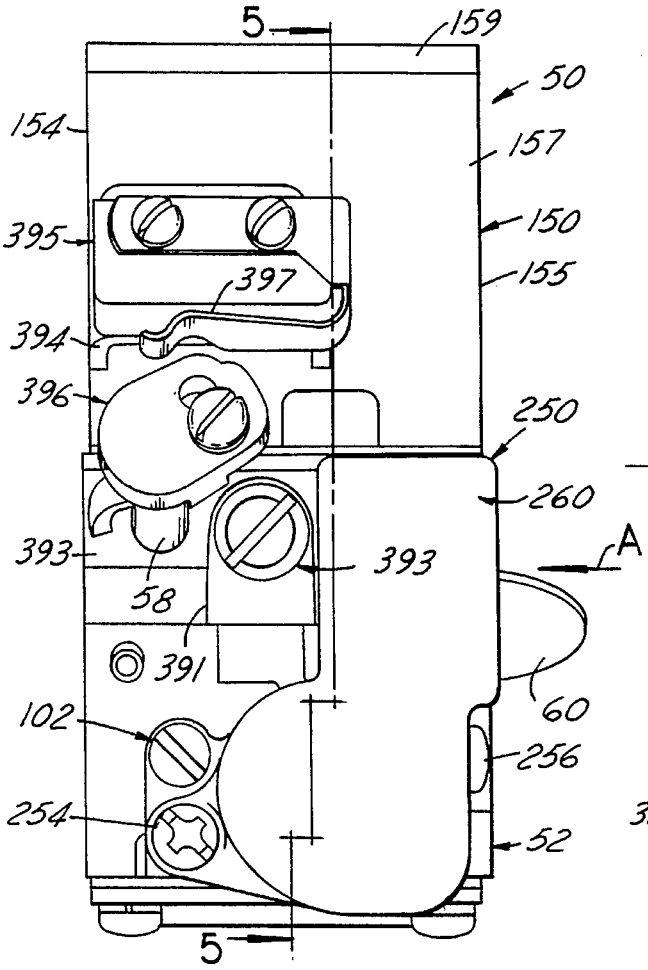
FIG. 10 is a side elevational view of the right hand side of the carburetor as viewed in FIG. 1.

Referring to FIGS. 1, 5 and 10–32, in accordance with another feature of the invention an electro-mechanical self-locking worm gear drive unit 250 is detachably side-mounted to carburetor 50 for operating needle valve 84 in opposite rotary directions. Drive unit 250 comprises a two-piece housing 260, 262 detachably secured to a side mounting boss 252 of carburetor body 52 by screws 254 and 256 (FIG. 10). The outboard and inboard parts 260 and 262 of housing 250 are shown by themselves in FIGS. 11–18 and in FIGS. 19–24 respectively. Housings 260 and 262 are preferably made as one-piece injection molded plastic parts and are suitably cored and machined as necessary to provide the cup-like structure and configuration of these parts as shown to scale in FIGS. 12–24. Housing parts 260 and 262 are complimentarily contoured to fit together in flat face-to-face abutment with their open sides facing one another to thereby define three communicating housing interior compartments 264, 266 and 268 for respectively receiving therein a stepping drive electric servo motor (not shown), a worm gear 270 (FIGS. 25 and 26) and a helical spur gear 272. Housing parts 260 and 262 are removably held together by a pair of machine screws (not shown) inserted through upper and lower mounting openings 271 and 273 in part 260 and received in corresponding upper and lower threaded openings 274 and 276 in part 262.

Worm gear drive 250 as assembled contains a commercially available electronically controlled stepping electric motor (not shown), such as that made by Mabuchi Motor Company of Japan, Model FFN20PA. The motor and worm gear 270 are a rigid subassembly with the motor output drive shaft 280 (FIG. 25) inserted coaxially into a blind bore 282 in the upper end of worm gear 270 with a press fit and thereby fixed against rotation relative to gear 270. The motor and worm gear subassembly is first inserted sideways into the open outboard casing part 260, an upper armature protrusion on the motor (not shown) registering with and held non-rotatably in a keying slot 284 provided in a boss 286 of at the upper end of casing part 260. The lower outer circular edge of the motor rests on a shelf or housing ledge 288 which positions worm gear 270 in compartment 266 with its cylindrical lower stem 290 rotatably received in a laterally open recess 292 provided at the bottom of casing part 260.

Figure 25:
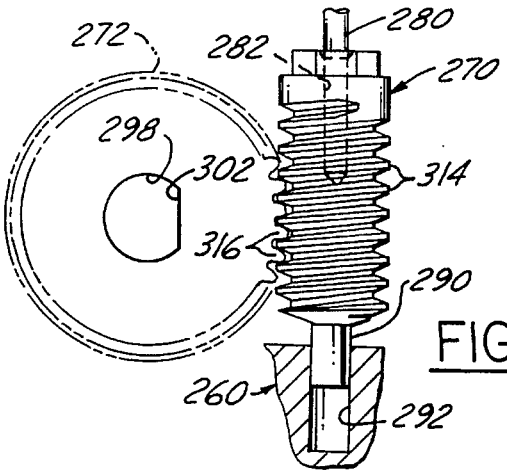
FIG. 25 is an enlarged fragmentary view in vertical elevational of the worm gear and associated helical spur gear drive for the high speed A/F ratio adjustment needle of the invention shown by themselves.

Next, a subassembly of the helical spur gear 272 and a drive unit output shaft 294 (FIG. 26) is first separately assembled by inserting a gear hub portion 296 of shaft 294 into the central throughbore 298 of gear 272. A flat 300 of hub portion 296 registers with a flat 302 of gear hub 298 to thereby non-rotatably key these parts together. A E-ring retainer 304 is then inserted in a groove 306 of shaft 294. Then this subassembly of gear 272 and shaft 294 is inserted endwise into outboard casing part 260 to register the reduced diameter cylindrical bearing nose 308 of shaft 294 in a cylindrical blind journal pocket 310 formed in an inboard protruding journal boss 312 of casing 260, while also meshing the worm teeth 314 of worm gear 270 with the helical spur teeth 316 of gear 272 (FIGS. 25 and 26).

Figure 12:
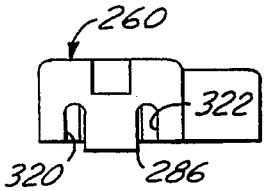
FIGS. 12 and 13 are top plan and elevational views respectively of the housing outboard part of FIG. 11.
Figure 18:
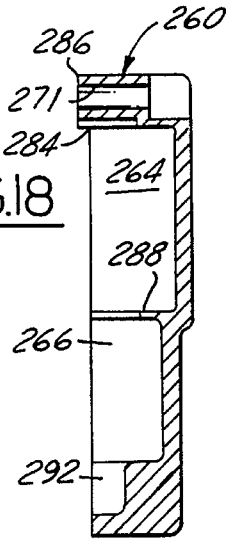
FIGS. 16, 17 and 18 are cross-sectional views taken respectively on the lines 16—16, 17—17 and 18—18 of FIG. 11 with FIG. 18 enlarged thereover.
Figure 13:
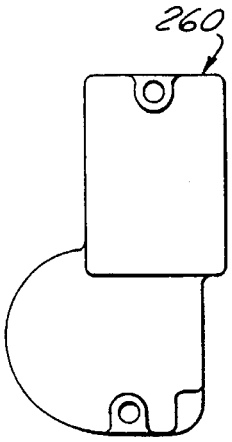
Figure 14:
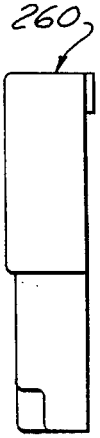
FIG. 14 is a side elevational view of the left hand side of the housing part as viewed in FIG. 11.
Figure 11:
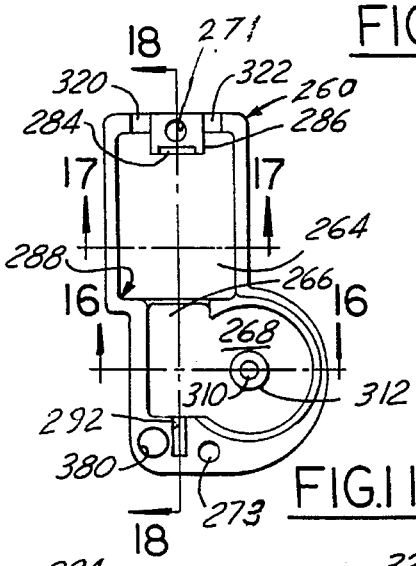
FIG. 11 is a elevational view (on a reduced scale relative to FIGS. 1, 5 and 10) of the outboard part of the gear motor housing shown by itself and viewing the interior thereof.
Figure 15:
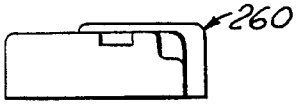
FIG. 15 is a bottom plan view of the housing part as viewed in FIG. 13.
Figure 16:
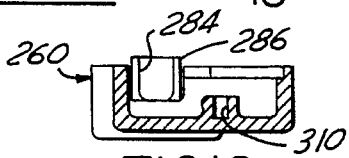
Figure 17:
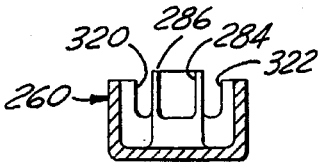

The electrical lead wires for the motor (not shown) are fed into a pair of housing 260 via through-slots 320 and 322 provided in the upper wall of casing part 260 and flanking boss 286 (FIGS. 11 and 12).

Figure 20:
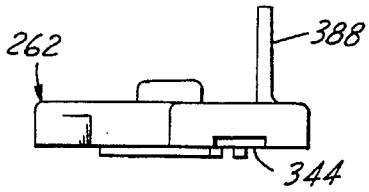
FIG. 20 is a top plan view of the housing inboard part of FIG. 19.
Figure 21:
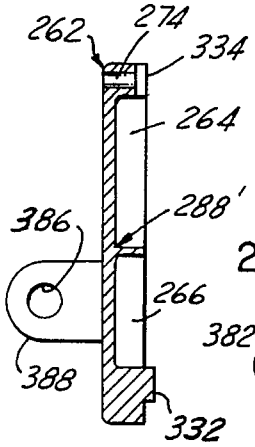
FIGS. 21 and 22 are cross-sectional views taken respectively on the lines 21—21 and 22—22 of FIG. 19.
Figure 19:
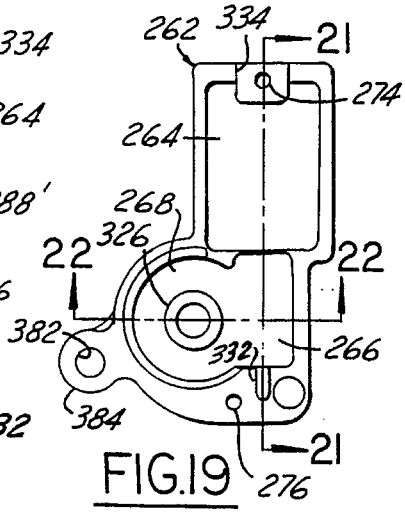
FIG. 19 is a elevational view (on the scale of FIGS. 11–17) of the inboard part of the gear motor housing shown by itself and viewing the interior thereof.
Figure 23:
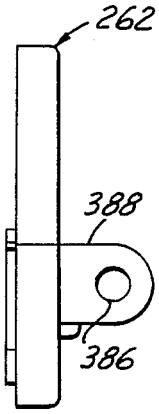
FIG. 23 is a side elevational view of the right hand side of the housing inboard part as viewed in FIG. 19.
Figure 24:
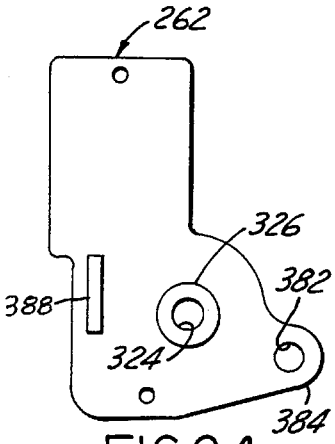
FIG. 24 is a rear elevational view of the housing inboard part of FIG. 19.
Figure 22:
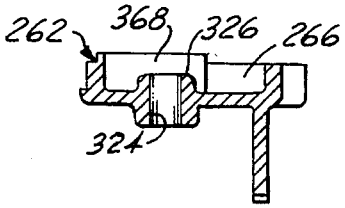
Figure 26:
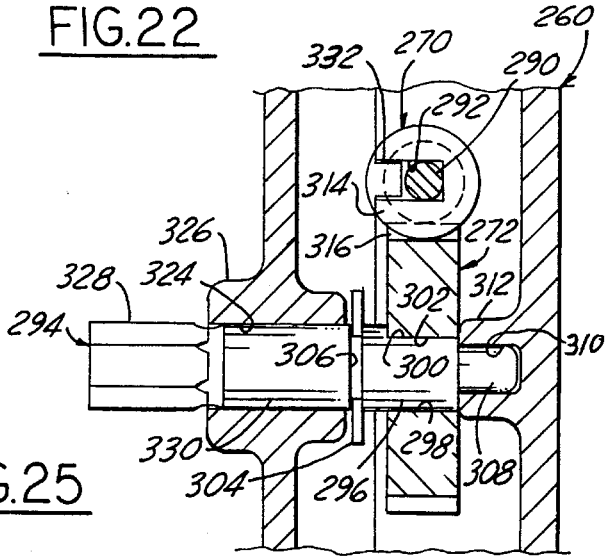
FIG. 26 is a fragmentary cross-sectional view taken on the line 26—26 of FIG. 5 but greatly enlarged thereover.

Then housing inboard part 262 is assembled to outboard part 260 by registering and inserting shaft 294 through a journal bore 324 of a main journal hub 326 of part 262 so that a hex head end portion 328 of shaft 294 protrudes from part 262 and a cylindrical bearing portion 330 of shaft 294 is journalled in bore 324 as shown in FIG. 26. The two housing parts are accurately aligned in assembly with their outer flush surfaces abutting by inserting a key tab 332 of inboard part 262 into worm gear journal pocket 292 of part 260 (FIG. 26), and by inserting boss 286 of part 260 into a complimentary pocket 334 provided in the upper end of part 262 (FIGS. 19–21). This aligns the fastener holes in the upper and lower ends of these casing parts, and also the shelf ledge 288' of part 262 with the corresponding shelf ledge 288 of part 260 to provide a substantially 360° ledge for supporting the lower edge of the motor when the motor is thus confined in the motor pocket cavities 264 of the mating housing parts and the two parts are abutted at a co-planar assembly parting line 336 (FIG. 5 ).

With housing parts 260, 262 so assembled, tab 332 is positioned in journal pocket 292 with its end face spaced closely adjacent journal stem 290 of gear 270 to thereby form a closed journal pocket for the lower end of the worm gear. The upper end of the motor is now non-rotatably trapped in housing slot 284 which is closed at its inboard end by part 262. The housing parts 260 and 262 may then be fastened together by inserting the aforementioned fasteners in the registered and aligned upper fastening holes 271, 274 and lower holes 273, 276 of the casing parts.

Next, a coupling sleeve 340 (FIGS. 30–32) is press fit onto hex end portion 328 of shaft 294 with its internal hexagonal bore 342 registering non-rotatably therewith, the assembled position of coupling sleeve 340 on shaft 294 being shown in FIGS. 5 and 6. The subassembly of gear motor drive unit 250 is now complete and ready for assembly to carburetor 50.

Figure 27:
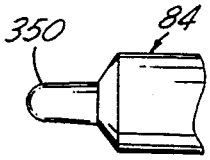
FIG. 27 is an enlarged side elevational view of the high speed adjusting needle valve of the invention shown by itself.
Figure 28:
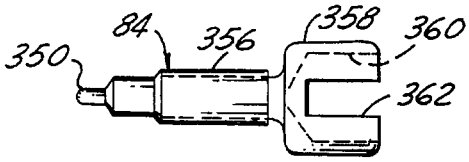
FIG. 28 is a fragmentary side elevational view of the nose end of the needle valve of FIG. 27 but enlarged thereover.
Figure 29:
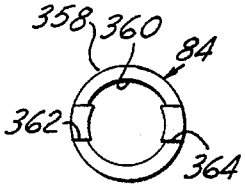
FIG. 29 is an end elevational view of the right hand end of the needle valve shown in FIG. 27.
Figure 30:
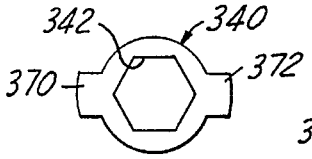
FIG. 30 is an end elevational view of a sleeve insert for coupling the output shaft of the worm gear drive to the needle valve as shown in FIG. 5, but shown by itself and enlarged thereover.
Figure 31:
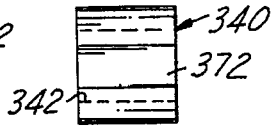
FIGS. 31 and 32 are side elevation and plan views respectively of the insert of FIG. 30.
Figure 32:
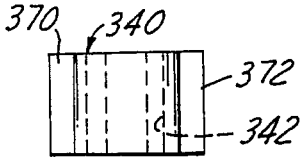

High speed mixture needle 84 is preferably first assembled to its operative position in carburetor body 52 as shown in FIG. 5 prior to attachment drive unit 250. As best seen in FIGS. 27–29, needle 84 has a slightly conically tapered valve nose 350 which fits coaxially in body passage seat 88 to vary the fuel flow cross-section thereof in response to axial movement of needle 84 as it is threaded back and forth in body 52. A cylindrical bearing portion 352 of needle 84 is rotatably journalled and axially slidable within a counterbore 354 coaxial with passage 88 and an externally threaded portion 356 of needle valve 84 is threadably received in the internally threaded passage 86 of carburetor body 52. Needle 84 has a slotted cylindrical driving head 358 having a blind bore 360 open at its outboard end, and a pair of diametrically opposite driven slots 362 and 364 (FIGS. 27 and 29) opening to bore 360. Head 358 is axially slidable and journalled in another counterbore 368 coaxial with threaded bore 86 and opening at the outer face of carburetor boss 252 (FIG. 5).

To assemble worm gear drive unit 250 to carburetor 50 and operably drivingly couple the same to needle 84, unit 250 is juxtaposed to boss 252 as shown in FIG. 5 to insert a pair of diametrically oppositely protruding driving wings 370 and 372 of coupler 340 (FIGS. 30–32) into needle head slots 364 and 362. The operatively engaged position of coupler 340 with needle 84 is shown in FIG. 5 wherein the inboard face of housing part 262 abuts the outboard face 252 of the carburetor boss 252. As shown in FIG. 6, coupler 340 is dimensioned to have a close sliding fit with the mating and registering portions of needle head 358.

Drive unit 250 is fastened to carburetor body 52 by inserting mounting screw 254 through hole 380 of part 260 (FIG. 11), and then threading it through a screw hole 382 in a mounting tab 384 of part 262 (FIGS. 19 and 24) and thence into a threaded opening (not shown) provided in the side face of body 52. The other drive unit mounting screw 256 is inserted through a screw hole 386 of a mounting tab 388 of part 262 and thence into a threaded opening (not shown) provided in the front face carburetor body 52. This securely detachably mounts unit 250 to carburetor body 52 and maintains coupler 340 in axially fixed position for rotatably driving needle 84 in opposite rotary directions under the control of the stepping motor of unit 250. Rotation of the stepping motor in either rotary direction is transmitted through worm gear 270, helical gear 272, shaft 294 and coupler 340 to thereby rotate needle 84 to threadably move needle nose 350 so as to enlarge or reduce the fuel flow cross section through passage seat 88.

Preferably gear motor drive unit 250 has a high gear reduction ratio through the worm gear drive 270, 272 of say 37:1. The aforementioned DC drive motor provided in drive unit 250 is designed accordingly to provide only a few degrees of rotational travel of needle 84 for each one milli-second voltage input. Due to its high gear reduction ratio, worm gear drive 270, 272 produces a mechanical self-locking, anti-rotation action against any vibrationally induced needle rotation in either direction in the off condition of the motor. Hence needle 84 is locked in adjusted set position throughout the off cycle of the motor of drive unit 250, and during engine shut-off.

Both the gear motor of drive unit 250 and solenoid 272 are powered by the ignition module of the engine to which carburetor 50 is mounted, and preferably each are relatively low power consumption devices. For example, the aforementioned gear motor typically consumes about 4 watts during its on duty-cycle, whereas the solenoid 172 typically consumes about 5 watts of power during its on duty-cycle. Moreover, in accordance with another feature of the present invention, total power requirements are further reduced because the gear motor and solenoid are never activated at the same time in performing their respective A/F adjustment and lean-out test functions in the automatic mode of operation of carburetor 50.

Geometrical Configuration of Carburetor 50

In accordance with a further geometrical packaging feature of the present invention, carburetor body 52 is formed with an asymmetrical cross section as viewed in FIGS. 1 and 5, i.e., the same is skewed in the plane of the drawing (perpendicular to the axis of venturi passage 54) to the left as viewed in these figures at an angle of about 25° to the vertical. The top and bottom wall surfaces 389 and 390 of body 52 are oriented flat and parallel to one another and to the axis of venturi passage 54 in accordance with conventional small carburetor practice. However top wall 170 is formed with a ledge extension portion 391 (FIGS. 1 and 5) which protrudes horizontally from the left side of the carburetor to enable a laterally offset mounting of control housing 150 relative to carburetor body 52. As best seen in FIG. 10, the front and rear sides of carburetor body 52 and the front and rear side walls 154 and 155 of housing 150 are oriented generally flush with one another such that the overall front and rear sides of the carburetor 50 extend vertically generally parallel with one another in planes perpendicular to the venturi axis. However the opposed side walls of carburetor body 52 have inclined surface portions 392 and 393 (FIGS. 1 and 5) oriented at the 30° skew angle through which both throttle shaft 58 and choke shaft 62 protrude at their axially opposite ends. These shafts are likewise skewed at about 25° to horizontal as viewed in the drawings.

The laterally skewed geometry of carburetor 50 and the corresponding lateral offset of housing 150 advantageously provides an exterior cavity in which the choke/throttle lock-out mechanism 400–468 (described subsequently herein) is operably received on the left hand ends of the associated throttle and choke shafts. As best seen in FIG. 1, this control linkage mechanism is thus disposed beneath ledge 391 and protectively contained within the exterior corner space defined by the extension of the major exterior planes of the left side wall 156 and bottom cover 76 of carburetor 50.

Referring to the right hand side of carburetor 50 as seen in FIGS. 1, 5 and 10, control housing wall 157 is provided with an integral shelf wall 394 protruding downwardly and outwardly therefrom at the aforementioned 25° skew angle from vertical. Shelf 394 provides a platform on which an electrical switch mechanism 395 is removably mounted (FIGS. 1, 3 and 10). The exteriorly protruding right-hand end of throttle shaft 58 is provided with associated conventional throttle stop and spring structure (FIGS. 1 and 8) adapted to cooperate in a conventional manner with a body stop boss 391 and throttle stop low idle adjustment screw 393, as well as a switch actuating cam 396. A spring lever 397 on switch mechanism 395 is actuated by cam 396 at an appropriate point in throttle shaft rotation to thereby enable and disable appropriate downstream operational stages of the electronic circuitry of the automatic A/F control system incorporated in housing 150.

It thus will be seen in comparing FIGS. 1 and 10 that switch mechanism 395 as well as switch operating cam 396 and the other throttle stop and biasing structure mounted on the end of throttle shaft 58 are also protectively disposed within the confines of an exterior cavity spaced defined by the projections of the exterior planes of drive unit 250 and top wall 159 on the right hand side of carburetor 50.

Hence the skewed orientation of carburetor body 52 and complemental inclination of the choke and throttle shafts cooperates with the offset relationship of control housing 150 to provide a compact package and protected environment for the exterior parts of the carburetor despite the need to accommodate in this overall carburetor package the additional control circuitry components and solenoid valve structure of the automatic electrical A/F fuel metering system incorporated into carburetor 50.

Choke Lock-Out System and Mechanism

In accordance with yet another feature of the present invention, carburetor 50 is provided with a choke lock-out safety system of the invention which overcomes the aforementioned problem of intentional or unintentional operator partial choking manipulation of the choke valve away from full open position when the throttle valve is positioned between fast idle and full open position. Hitherto, such choke manipulation often occurs as a misguided effort to hasten the warm up phase of the running engine by intentionally over-enriching the air/fuel mixture by partial choking. However, the choke lockout feature of the invention prevents such adverse over-enrichment by blocking the choke valve from being actuated at any throttle valve angle above a predefined value. This in turn prevents undue fuel from entering the engine and exhaust system, as well as preventing atmospheric exhaust pollution, otherwise resulting from choking during engine run conditions. This, of course, is also an important feature for use on a conventional non-electrical carburetor not equipped with the automatic A/F control system and mechanism of the present invention. This is particularly true when either type of carburetor is used on an engine equipped with a catalytic converter (which is also the preferred mode for an engine equipped with the electric carburetor of the present invention). Nevertheless, even if no converter is present, the choke lock-out feature is of at least equal importance to successful operation of carburetor 50 equipped with the feedback control method and mechanism for automatically controlling A/F in accordance with the present invention.

Generally speaking, the choke lock-out safety system and mechanism of the invention operates to prevent the choke valve from being moved from wide open toward closed position at any predetermined range of throttle valve opening. In the exemplary case of the illustrated embodiment herein, choke blocking occurs when the throttle valve is open anywhere in the range between slightly past fast idle position to full open position.

The choke lock-out safety feature also incorporates the conventional choke-throttle cold-start setting latch mechanism so that the improved system is also operable, when the choke valve is fully closed for engine start-up, to automatically slightly open the throttle valve, i.e., move it from low to fast idle, and to hold it latched in this position for start-up. This latch mechanism positively prevents movement of the throttle valve back toward low idle position but releasably yields to throttle opening force applied through the throttle control linkage to thereby unlatch the mechanism and thereby automatically return the choke valve to wide open position.

In general, the foregoing mode of operation of this feature of the invention is economically accomplished by simply adding material to the throttle and choke levers of the conventional start-up interlock mechanism such that each of these levers as so modified will block the movement of the opposing lever after the predetermined angular rotation value has been reached. As will become apparent hereinafter, this basic improvement concept can be provided on carburetors in which the throttle and choke shafts operate in either the same or opposite rotary directions during their respective control movements between respective open and closed positions. However, depending upon the rotational direction of the choke and throttle shafts, the system and mechanism of this feature of the invention will vary slightly from the simpler version shown in the same rotational direction embodiments of FIGS. 48–50 to that of the counter-rotation embodiments of FIGS. 33–35, and as applied to carburetor 50 as described hereinbefore.

Figure 40:
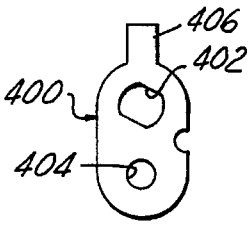
FIGS. 40 and 41 are respectively side elevational and end elevational views of the choke lever part of the choke lock-out mechanism of FIGS. 33–35 shown by itself.
Figure 38:
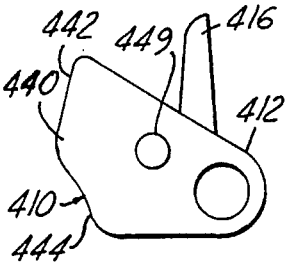
Figure 39:
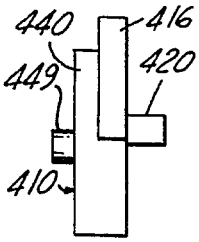
Figure 37:
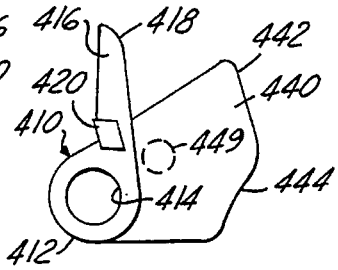
Figure 41:
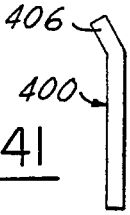
Figure 42:
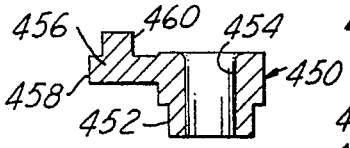
FIGS. 42, 43, 44 and 45 are respectively a cross-sectional view taken on the line 42–42 of FIG. 43 (FIG. 42), a side elevational view (FIG. 43), an end elevational view (FIG. 44), and a reverse side elevational view (FIG. 45) of the fast idle stop part of the choke lock-out mechanism shown by itself on a reduced scale relative to that of FIGS. 33–35.
Figure 43:
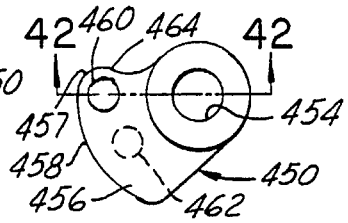

FIGS. 1, 4, 8 and 33–47 illustrate the choke lock-out safety feature of the invention as applied to the counter-rotation carburetor 50 in which choke valve 60 is normally yieldably spring biased to rotate in a counterclockwise direction (as viewed in FIGS. 33–35) toward the full open position of FIG. 34, whereas throttle valve 56 is yieldably spring biased against its rotation in a clockwise direction to full open position as shown in FIG. 35. In this type of carburetor as hitherto conventionally constructed, choke shaft 62 receives thereon a choke lever 400 (FIGS. 1, 4 and 33–35), which is constructed as shown separately in FIGS. 40 and 41. Choke lever 400 has a flatted oval mounting opening 402 which keys it non-rotatably on choke shaft 62 for rotation therewith, and has an opening 404 for connection thereto of the conventional manual throttle control linkage (not shown). The upper end of lever 400 has a tang 406 slightly inclined inwardly towards the carburetor body.

Choke shaft 62 also has mounted for free rotation thereon a fast idle lock lever 410 constructed as separately shown in FIGS. 36–39. Lever 410 has a hub 412 with a throughbore 414 for journalling lever 410 on shaft 62. A conventional locking finger 416 protrudes radially outwardly from hub 412, and has a curved camming surface 418 at its free end. Finger 416 also has a laterally protruding wing tab 420 yieldably biased by a spring 446 (FIG. 8) into abutment with tang 406 of lever 400 (FIG. 4).

Figure 46:
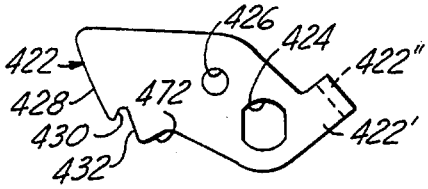
FIGS. 46 and 47 are side elevational and end elevational views respectively of the throttle lever part of the choke lock-out mechanism slightly enlarged over the showing thereof in FIGS. 33–35.
Figure 44:
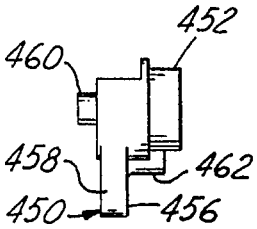
Figure 45:
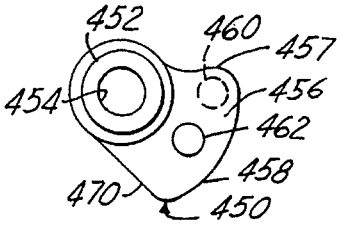
Figure 47:
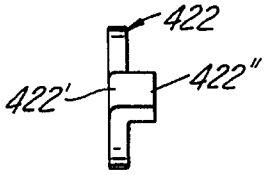

Throttle shaft 58 carries a throttle lever 422 constructed as shown separately in FIGS. 46 and 47. Lever 422 has a flat oval mounting opening 424 which is received on a mating flatted portion of throttle shaft 58 to key the same together for conjoint rotation. An opening 426 is provided in lever 422 for connection thereto of the usual manually operated throttle linkage (not shown) for imparting controlled rotation to the throttle shaft. The outer free end of lever 422 is provided with a convexly curved camming surface 428 and a cold-start locking notch defined by convergent reentrance surfaces 430 and 432 in the usual fashion.

Figure 33:
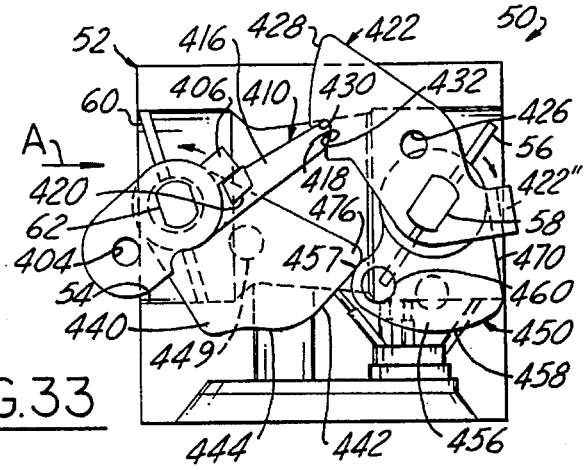
FIGS. 33, 34 and 35 are successive semi-diagrammatic illustrations of the choke throttle lock-out mechanism of the invention shown in FIGS. 1, 4 and 8 and superimposed on a cross section of the carburetor body venturi passage and associated choke and throttle butterfly valves, FIG. 33 showing the choke valve in closed position and the throttle valve in fast idle position, FIG. 34 showing the choke fully opened and the throttle valve in normal idle position and FIG. 35 showing both valves fully opened.

Choke lever 400, fast idle lock lever 410 and throttle lever 422 are thus designed to cooperate to provide a cold-start fast idle locking interengagement between choke and throttle valves 60 and 56 in accordance with conventional practice. With the engine shut off and the throttle control backed to off the engine low idle setting, throttle lever 422 will be yieldably held in the normal (slow or low) idle position of FIG. 34 with throttle valve 56 likewise biased by a spring 433 (FIG. 8) to its substantially fully closed low (normal) idle position shown in FIG. 34. Then, to start up the engine, the operator rotates choke valve 60 by manipulating the choke control linkage to rotate valve 60 clockwise from the wide open position of FIG. 34 to the fully closed position of FIG. 33. During this rotation tang 406 pushes on tab 420 to likewise rotate lock lever 410 clockwise from its position in FIG. 34 to its position in FIG. 33. Thus, as choke lock lever 410 swings toward throttle lever 422 during rotation of choke valve 60 toward closed position, camming surface 418 of finger 416 will strike camming surface 428 to initially cam lever 422 in a clockwise direction, against the force of the throttle biasing spring, until the free end of finger 416 enters and locks into the notch surfaces 430 and 432 as shown in FIG. 33. This camming interengagement thereby rotates throttle valve 56 from the low (normal) idle position of FIG. 34 clockwise to the fast idle position of FIG. 33. This automatically sets the throttle valve to the proper position for cold start when the choke is fully closed.

Once the engine is started and is running under its own power, the operator can manually open the choke valve to position it anywhere between closed and open as desired. However, cam finger 416 will remain latched with throttle lever 422 during such choke manipulation, thereby positively holding lever 422 (and the throttle valve) from retrograde movement back toward low idle, and also yieldably retaining lever 422 (and the throttle valve) against rotation out of latched start position toward full open. On the other hand, if the operator actuates the throttle control linkage to "crack" open the throttle valve, the resulting clockwise rotation of the throttle lever 422 will release the free end of cam finger 416 from the throttle lever notch 430/432, thereupon allowing the choke shaft biasing spring to rotate the choke valve counterclockwise from its fully closed back to its fully opened position. Thus, once the free end of finger 416 has been so disengaged from the throttle lever notch, the throttle valve can be positioned anywhere in its full range. If the throttle control is released the throttle shaft biasing spring will rotate throttle valve 56 clockwise back to its fully closed, normal idle position of FIG. 34 so that the engine then slows down to run at normal idle speed.

In order to convert the aforementioned conventional mode of operation of a choke/throttle fast idle interlock to provide the choke lock-out safety feature of the present invention, for a carburetor having counter rotational choke/throttle valve opening and closing motions as in the case of carburetor 50, the following modifications are made in accordance with the present invention.

First, a relatively large, flat blade-like extension 440 is added as an integral radially outwardly protruding extension of hub 12 of choke lever 410. This added material is shaped with a specially contoured blocking edge at the free end of stop blade 440 as defined by the compound curvature of surfaces 442 and 444 as seen in side elevation to scale in FIGS. 33–35 and separately in FIGS. 36–39 in one working example of the invention.

Further, a special throttle-choke lock-out lever part 450 is provided on throttle shaft 58 in accordance with the invention, the constructional details of which are shown to scale in FIGS. 42–45. Lever 450 has a hub 452 with a throughbore 454 for journalling part 450 for free rotation on throttle shaft 58 inboard of and adjacent to throttle lever 422. Lever 450 also has a specially contoured stop blade 456 formed as integral radially outwardly protruding extension of hub 452. Blade 456 has a specially contoured convex surface 458 defining its outer blocking edge at the free end of blade 456 having the contour and dimensional relationship shown to scale in FIGS. 33–35 and 42–45.

Lever 450 is also provided with a stop pin 460 protruding from the outboard side of blade 456 near its upper edge into the travel plane of lever 422, and a spring hook pin 462 protruding inboard from the center of blade 456 for receiving one end 464 of a lever biasing spring 466 (FIGS. 1 and 4). The other end of spring 466 terminates in a tang 468 protruding inboard to register with a keeper opening 469 in the carburetor body (FIG. 8). Stop blade 456 also has a convex toe edge surface 457 merging with outer edge convex surface 458 at the upper end of blade 456, and having the contour best seen in side elevation in FIGS. 33, 43 and 45.

One further modification is provided, namely an integral extension stop arm 422' is provided on throttle lever 422 so as to extend radially and tangentially relative to opening 424 and generally oppositely from the main blade arm of lever 422. Stop arm 422' terminates at its free end in an inboard extending stop tab 422' (FIGS. 46 and 47). In assembly and operation stop tab 422' abuttingly engages a radially extending stop edge 470 of stop blade 456 to limit counterclockwise rotation of lever 450 about shaft 58 and relative to lever 422 when these two parts are angularly spread apart to their positions shown in FIG. 33. Conversely, rotation of lever 450 clockwise about the axis of throttle shaft 58 relative to throttle lever 422 is limited by the abutment of pin 460 against a stop surface 472 of lever 422 when the blades of these two parts are rotated by spring 466 towards one another to their relative positions shown in FIGS. 34 and 35. It will be understood that, unless otherwise restrained, lever 450 will be yieldably biased by spring 466 to hold pin 460 against throttle lever 422 as the throttle lever 422 is actuated by the throttle linkage mechanism.

In the operation of the aforementioned choke throttle lock-out system and mechanism of the invention, it will now be seen from FIGS. 33–35 that stop blade 440 on fast idle lock lever 410 cooperates with stop blade 456 of the auxiliary throttle lever 450 to block movement of the opposing lever after a predetermined angular rotation value has been reached. Thus when choke valve 60 is rotated as described previously from its wide open position of FIG. 34 to its closed position of FIG. 33 to cause cold-start camming and latching lock up of finger 416 with throttle lever 422 as described previously, blade 440 conjointly rotates from the position of FIG. 34 to that of FIG. 33. During this pivotal motion of choke blade 440, blocking edge surface 444 abuttingly strikes blade toe surface 457 and then pushes on toe surface 457 to thereby rotate auxiliary throttle lever 450 counterclockwise from its position shown in FIG. 34 until its edge 470 almost engages stop tab 422" of main throttle lever 422 (FIG. 33). Throttle valve 456 is also now releasably latch locked in fast idle position by finger 416 as described previously. With choke valve 60 now fully closed and throttle valve 56 thereby automatically held in fast idle position, carburetor 50 is properly conditioned for cold start of the engine.

Moreover, if the operator should hold choke lever 400 in the position of FIG. 33, the throttle valve 456 now can only be rotated a short angular distance clockwise to open the same slightly beyond this fast idle position, i.e., only enough to permit finger 416 to disengage from notch 430–432, due to the blocking action of stop blade 440 against blade 456 once tab 422" strikes blade edge 470. This prevents further clockwise rotation of throttle shaft 458 under this condition due to the keyed mounting of lever 422 on this shaft.

Once the engine has been started and is running under its own power, the operator can manually operate the choke control linkage to rotate choke shaft 62 and force choke valve 60 counterclockwise between closed position of FIG. 33 and the wide open position of FIG. 34. The throttle valve 56 will remain latched in fast idle position during such choke manipulation. However, if and when the operator "cracks" open the throttle valve beyond fast idle position, the unlatching action occurs. Then the biasing force of choke spring 446 acts through spring tang 448 bearing against pin 449 of blade 440 (FIG. 4) to rotate choke lever 410 counterclockwise, and by tab 420 pushing on tang 406, pivots choke lever 400 and choke shaft 62 to their choke-open position of FIG. 34.

Initially during this choke lever unlatching motion, stop blade 440 likewise rotates counterclockwise with lever 410 from the position of FIG. 34 to that of FIG. 33. During the initial portion of this travel, toe 457 of blade 456 is spring biased to first ride freely along edge surface 442 of choke blade 440, the counterclockwise pivoting of blade 440 thereby unblocking auxiliary lever 450 so it can pivot clockwise as clearance opens up with blade edge surface 444. It will thus be seen that the cooperative contours of blocking edge surfaces 442 and 444 of blade 440 and blocking edge surface 457 and 458 of blade 456 causes these surfaces to separate so as to become spaced apart during this rotation, thereby enabling the auxiliary and main throttle levers 450 and 422 to be counter-pivoted by spring 466 to angularly close then together until pin 460 abuts lever stop surface 472. At the same time lever 422 is now free to be rotated, under operator control, slightly counterclockwise, from its unlatched position (slightly clockwise from that shown in FIG. 33) back to its fully closed normal idle position of FIG. 34, by throttle biasing spring 433. Choke valve 60 is now fully open and throttle valve 56 may now be in normal or slow idle position.

It is to be noted that in accordance with the foregoing choke/throttle interlock mechanism of the invention, both throttle valve 56 and choke valve 60 can be either normally opened or closed, but only one at a time. That is, if the operator rotates choke valve 60 to closed position, its stop blade 440 will block, through the coplanar travel interference interaction with stop 450, and the restraint of tang 422, opening motion of throttle valve 56 past slightly beyond the fast idle position of FIG. 33. Likewise, if throttle valve 56 is opened beyond slightly past its fast idle position, the edge contour of stop blade 456 blocks closing motion of choke valve 60 due to the abutting interference of respective blade stop surfaces 458 and 444 because, during this range of throttle motion, stop 450 and lever 422 are yieldably held angularly closed together as a unit by spring 466.

Thus, so long as throttle shaft 58 is angularly oriented between slightly past fast idle position and low (normal) idle position, but only when so oriented in this range, choke valve 60 can be closed or otherwise manipulated toward closed position from its open position. Therefore, the operator cannot "play" with the choke to partially close it when the throttle is advanced past fast idle, which hitherto has occurred when the operator improperly partially chokes the engine to cause over enrichment of the mixture A/F to hasten engine warm-up. Accidental movement of the choke valve toward closed position is likewise prevented when the throttle is advanced past fast idle. The choke lock out system thus prevents undue or excessive fuel from entering the engine combustion chamber and thereby causing smoke and other atmospheric pollutants to be emitted with the engine exhaust. If the engine is equipped with a catalytic converter, this system will likewise prevent raw fuel from being dumped into the converter thereby impairing its operation and even permanently damaging the converter.

When the engine is equipped with an electric carburetor 50 embodying the aforementioned electronic feedback control method for adjusting A/F, the choke/throttle lock out system also will prevent the operator from defeating or impairing this system by partial choking during engine running above fast idle, and thereby causing the automatic control system to respond to such an adverse over enrichment condition in a manner to cause faulty engine operation or unwanted shut-down. For example, assume that after the engine had been started the operator were attempting to warm up the engine by running it at some advanced throttle setting beyond fast idle. Assume also that during this period a sufficiently constant engine speed condition had been achieved to start the test cycle of the automatic feedback control system. Then further assume that, in the absence of this choke/throttle lock-out system, the operator were allowed to manipulate the choke valve for partial choking. The automatic control system would sense this overenriched condition and then drive the mixture ratio toward the lean side in order to correct for the overly rich A/F caused by such improper conjoint positioning of the throttle and choke valves. However, once the operator released the choke valve the A/F would have been automatically leaned out too far to operate properly for such part-throttle/choke open setting. This could then induce unwanted engine stall before the automatic system could test, adjust, enrich and recover to the correct A/F mixture under these operator-induced adverse conditions.

Second Embodiment of Choke/Throttle Lock Out System

Figure 48:
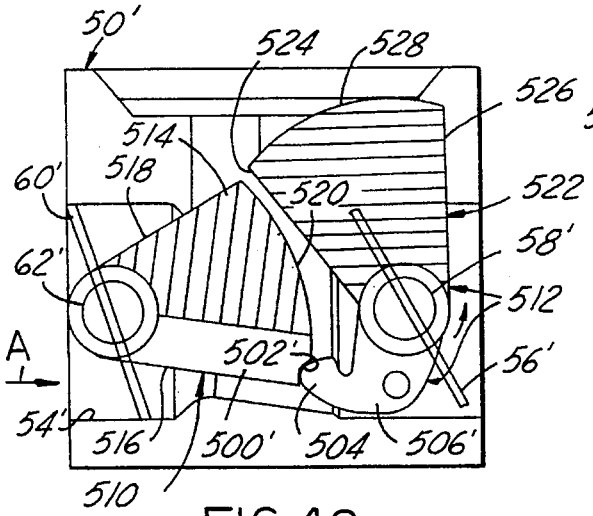
FIGS. 48, 49 and 50 are sequential positional views similar to those of FIGS. 33–35 illustrating a second embodiment of a choke throttle lock-out mechanism of the invention as applied to a conventional non-automatic or automatic diaphragm carburetor wherein the choke and throttle valves operate in the same rotary direction between closed and opened positions thereof.
Figure 49:
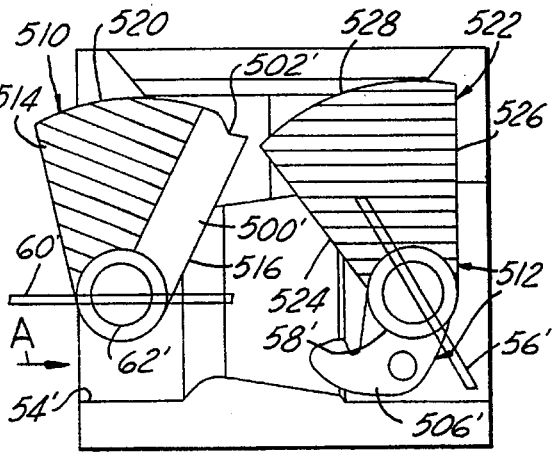
Figure 50:
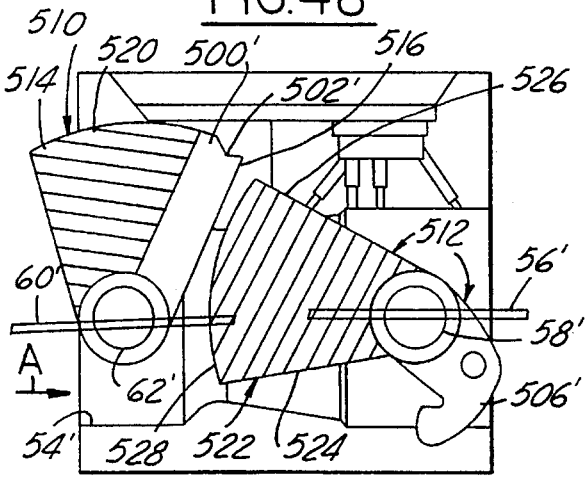
Figure 51:
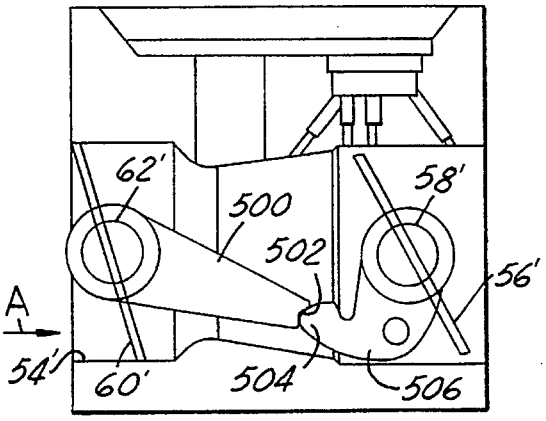
(PRIOR ART) FIG.51
FIG. 51 is a view corresponding to FIGS. 48–50 but illustrating a prior art conventional choke-throttle interlock mechanism for holding the throttle valve in its fast idle, cold-start position in the type of carburetor illustrated in FIGS. 48–50.

Referring to FIGS. 48–50, a second embodiment of the choke/throttle lock-out feature of the present invention is illustrated as applied to a carburetor in which the choke and throttle valves operate in the same rotary direction between their respective open and closed positions. For comparison purposes, FIG. 51 illustrates semi-schematically a prior art carburetor of this type equipped with a standard choke-throttle cold-start interlock latch mechanism for releasably holding the throttle valve in fast idle position when the choke is moved to cold start position. FIGS. 48–50 illustrate how this prior art carburetor is modified in accordance with a second embodiment of the choke/throttle lock-out feature of the invention to prevent the choke from being actuated at any throttle angle above a predefined value. In these views those parts and elements corresponding to those of like structure and function in carburetor 50 are given like reference numerals raised by a prime suffix and their detailed description not repeated.

In FIG. 51 it will be seen that choke shaft 62' carries a locking finger 500 having a camming interlock notch 502 at its free end adapted to releasably engage a camming toe 504 of a locking lever 506 keyed on the throttle shaft 58' for rotation therewith. Thus when choke valve 60' is rotated clockwise (as viewed in FIG. 51) from wide open to cold start position (shown in FIG. 51), throttle valve 56' will be rotated clockwise from normal to fast idle position (shown in FIG. 51). Once the engine has started and is running under its own power and choke valve operator returned to wide open position, lever 500 disengages from and releases lever 506, thereby allowing throttle valve 56' to be rotated clockwise by the operator, and by its spring, to fully closed, normal (low) idle position, as well as counterclockwise back to full open position. Thus it will be seen that with this conventional choke/throttle cold start interlock there is nothing to hinder closing motion of the choke valve when the engine is running at any speed.

However in accordance with the choke/throttle lock-out feature of the present invention operator-induce or accidental engine malfunctioning by choking is prevented by modifying the type of carburetor and cold start interlock linkage of FIG. 51 in the manner shown in FIGS. 48–50. Again, this is accomplished by simply adding material to the choke and throttle levers such that they will block the movement of the opposing lever after a predetermined angular rotation value has been reached. In accordance with this feature of the invention, the added material is constructed and arranged, as in the first embodiment, to prevent the choke valve from being moved from wide open toward closed position at any predetermined throttle valve opening orientation, e.g., in the range between slightly greater than the fast idle position to wide open, and also, as in the first embodiment, to prevent the throttle valve from being opened any further than a predetermined throttle valve opening angle, e.g., slightly beyond fast idle position, when the choke valve is partially or fully closed.

More particularly, and referring to FIG. 48, a modified choke lever 510 is provided having an interlock portion 500' corresponding to lever 500 to perform its cold-start latching function relative to interlock portion 506' of a modified throttle lever 512. However choke lever 510 is enlarged in the direction of its rotation over that of lever 500 by adding material thereto in the form of a lock-out or blocking blade portion 514 (shown heavily shaded in FIGS. 48–50), that is integrally joined to portion 500' and extends coplanar therefrom in the plane of its rotary travel. Choke lever 510 thus has a pie shape with an included angle of say 45° between its radially extending leading edge 516 and trailing edge 518, and has extending and therebetween a peripheral arcuate "blocking" free edge 520 of convex contour in the rotational plane of travel of lever 510, the same being shown to scale in the views of FIGS. 48–50.

Likewise, throttle lever 512 is modified by adding a lock-out blade portion 522, also of pie shape, that is integrally joined to lever portion 506' and extends coplanar therefrom but in a generally diametrically opposite direction. Blade portion 522 also has an included angle of about 45° between its radially extending leading and trailing edges 524 and 526, and likewise has extending therebetween peripheral arcuate "blocking" edge 528 having the convex configuration in the rotational plane of travel of lever 512 as shown to scale in FIGS. 48–50.

In the operation of the second embodiment of the choke lockout feature of the invention, choke valve 60' only can be rotated clockwise from wide open (FIG. 49) to cold-start position (FIG. 48) while throttle valve 56' is controllably held between the fast idle position of FIGS. 48, 49 and its fully closed low (normal) idle position (not shown). During such choke rotation, the locking notch 502' of choke lever 512 will once again engage toe portion 504' of throttle lever 512 to move throttle 56' counterclockwise from low to the fast idle position shown in FIG. 48. Locking lever 510 will then hold the throttle valve in this position during the cold start operation in the manner described previously in conjunction with the prior art carburetor FIG. 51.

Although lever 510 and 512 have coplanar travel paths as well as mutually partially interfering paths of travel, it is to be noted that, with the throttle closed during this choke travel motion, choke lever edge 520 completely clears throttle lever edge 524 so that there is no blocking interference between choke lever 510 and throttle lever 512 during this choke motion. However, it will also be noted that with the choke in the closed position of FIG. 48, throttle valve 56' cannot be rotated counterclockwise in its opening direction more than a few degrees out of its fast idle position because blocking edge 520 of choke blade 514 will be struck by the leading edge 524 of throttle blade 522. Thus, such opening motion of the throttle is prevented when the choke is positioned in all but substantially wide open position. However such interference throttle blocking engagement does not impede choke rotation because, during this motion choke blade blocking edge 520 can slide along throttle blade blocking edge 524.

Once the engine has been started and choke valve 60' is rotated to its wide open position of FIGS. 49 and 50, either by the operator so controlling the choke linkage or by the operator "cracking" open the throttle past fast idle unlatching position, throttle valve 56' then can be rotated either clockwise out of its fast idle back to its fully closed, low idle position (not shown), or counterclockwise therefrom to its fully open position shown in FIG. 50. It is to be further noted that the trailing edge 516 of choke lever 510 either clears or slides along the free edge 528 of throttle lever 512 throughout its arc of travel during such pivotal throttle motion.

However, it is also to be noted that, when throttle lever 512 occupies any rotational position in the angular range from slightly beyond the fast idle position of FIGS. 48 and 49 to its fully open position of FIG. 50, throttle lever blocking edge 528 will block rotation of choke valve 60' clockwise from wide open towards its closed position. That is, after the first few degrees of choke motion in this direction choke blade leading edge 516 hits throttle blade blocking edge 528, but also without thereby impeding throttle rotation because edge 528 can slide along edge 516.

Hence the manual choke control mechanism is blocked from being operated, either accidentally or intentionally, to thereby prevent manipulation of choke valve 60' at any time when throttle valve 56' is positioned in its operational choke-lock-out range. It will also be noted that the manual throttle control mechanism is blocked from being operated, either accidentially or intentionally, to thereby prevent throttle valve 56' from being opened more than a few degrees beyond its fast idle position at any time when the choke valve is positioned in its operational partial to full chocking range. Nevertheless in the configuration illustrated in FIGS. 48–50, choke valve 60' can be closed for cold start whenever and only when throttle valve 56' is oriented between fast and low idle positions.

It is to be understood that the angular lock-out range of either the choke or throttle shaft can be readily varied by changing the appropriate profile of the appropriate lock-out blade 514 and/or 522. Also, this basic design principle of the choke/throttle lockout feature of the invention can be applied to either diaphragm or float carburetors. Moreover, as will now be understood by comparing the first and second embodiment constructions, the choke/throttle lock-out feature of the invention can be readily applied for any rotational direction of the throttle and choke shafts. The counter rotational mode of the choke and throttle valves of carburetor 50 simply requires the addition of blocking auxiliary throttle lever 450 to the throttle shaft as described previously. In both embodiments of the choke/throttle lock-out system, operator-induced and accidental engine malfunctioning is prevented in a manually controlled choke-throttle carburetor, thereby providing the important advantages of preventing environmentally polluting operation of an engine per se, preventing damage to a catalytic converter and/or preventing malfunctioning of an engine equipped with an electric carburetor 50 with an automatic electronic feedback control method for electronically and electro-mechanically adjusting A/F.

Overall Advantages

From the foregoing description of presently preferred illustrative embodiments of the invention and its various features, it now will be apparent that the invention amply fulfills the aforestated objects and provides many advantages over the prior art. The improved electric carburetor 50 of the invention incorporates in a compact, well protected package the electronic closed loop feedback control of mixture A/F to the engine with the manually controlled choke/throttle functions in a carburetor operating on a venturi aspiration principle. The automatic electronic system is essentially made operator fail-safe by the conjoint provision of the automatic mechanical idle circuit shut-off and accelerator pump feature, the self-locking and fine-adjustment action of the electro-mechanical worm gear drive 250, and the mechanical choke/throttle lock-out safety system. These features cooperate with the electronic A/F control system to insure reliable engine operation and improved control of A/F on the lean side for optimization of engine exhaust constituents to meet exhaust emission requirements being imposed on small engines. Thus it now will be seen that carburetor 50 solves the difficult problems of providing practical, economical and reliable carburetor hardware and mechanical systems needed to successfully implement on small engine appliances various automatic electronic and micro computer A/F control strategies and systems theoretically now available in the prior art.

Figure 52:
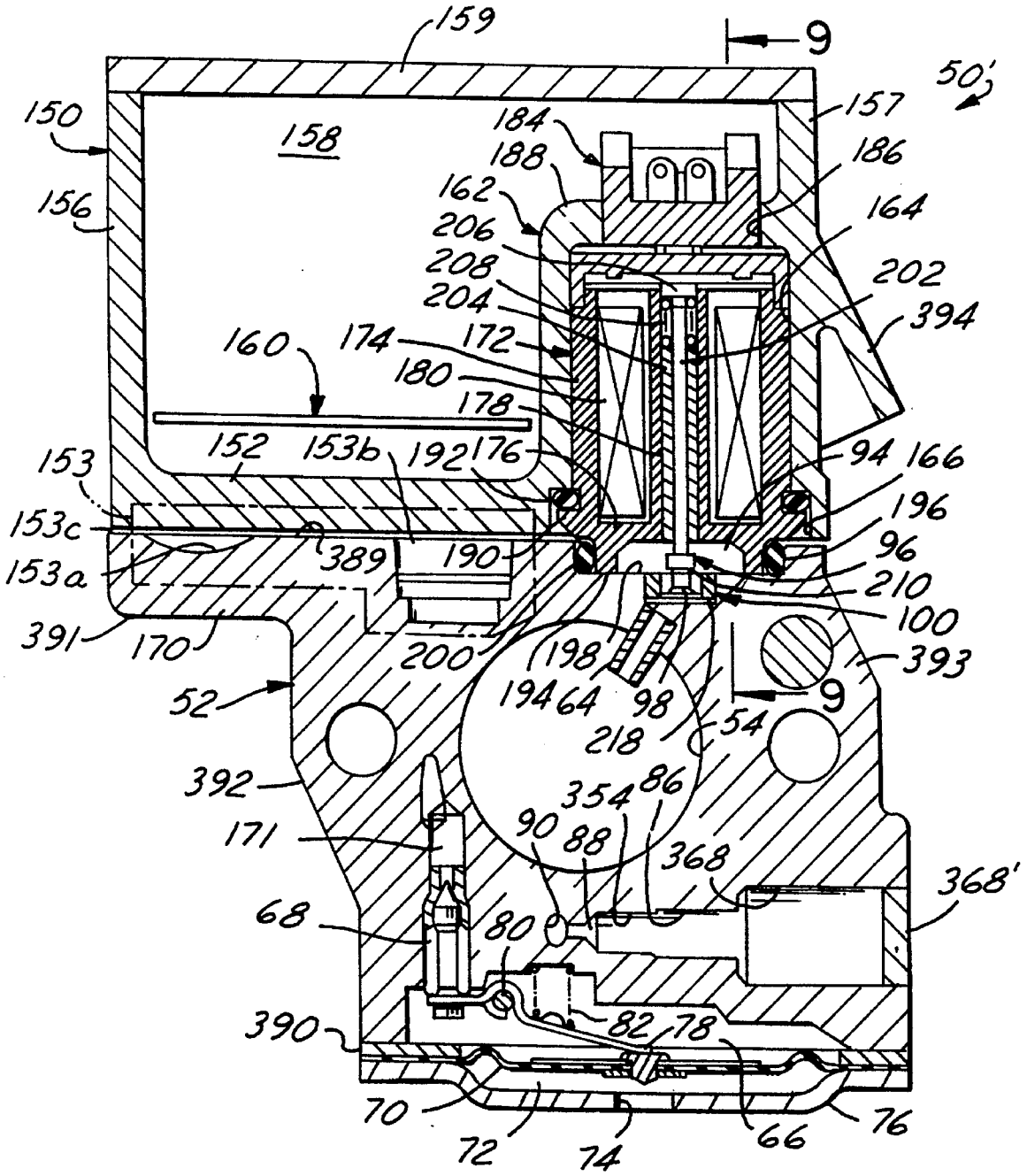
FIG. 52 illustrates a modified carburetor of the invention and is a view identical to that of FIG. 5 but with worm gear drive unit 250 and associated and high speed mixture needle 84 removed from carburetor 50 and counterbore 368 sealed by a plug.

By rendering the low speed circuit inoperable by opening the throttle valve to a predetermined angular opening (through the operation of valve 108) the total fuel flow is controlled by one or two fuel flow control valves, e.g., the motor-worm gear driven needle 84 and/or poppet valve 96, during this operational period. For example, FIG. 52 illustrates a modified carburetor 50' identical to carburetor 50, but with the worm gear drive unit 250 and associated needle valve 84 removed from carburetor body 52, and then counterbore 368 sealed at its outer end by a plug 368'. Fuel flow from metering chamber 66 to main jet nozzle 64 (via passage 86, open seat 88, body passage 90, body passage 92 valve chamber 94 and passage 98 of valve seat insert 100) is then under the sole control of the solenoid-actuated poppet valve 96. Thus valve 96 in carburetor 50' is then operable to provide the sole adjustment valve for controllably adjusting the A/F. This simplifies the job of the automatic A/F control system and renders it compatible with a diaphragm or float carburetor equipped with manually controlled choke and throttle valves and associated fuel circuits. Worm gear driving unit 250 provides a low cost housing and drive unit structure which can be readily sub-assembled and easily assembled to and disassembled from carburetor body 52 to thereby reduce the cost of manufacture and service drive unit 250 also provides a fine incremental control of the adjustment of needle valve 84 and reliably retains this setting during drive motor and engine shut-off.

The electrical and electronic components of the system are safely and securely contained in the control box housing 150, and the geometric skewing of the carburetor body with this housing provides a compact package in overall dimensions with corner cavity protection for exterior mechanically moving choke and throttle control components. Further simplification is obtained by incorporating the pulse operated diaphragm fuel pump in the wall structure between housing 150 and carburetor body 52. This feature also provides heat exchanger advantages in terms of intercooling of the circuitry and solenoid components in housing 150 and resultant fuel warming to promote fuel vaporization in the carburetor venturi passage 54.

The top-mounted solenoid 172 and its associated poppet valve 96 provides complete shut-off fuel control closely adjacent main nozzle 64 in downstream series flow relation with fuel control by needle 84. The action of the poppet valve disc 210 seating on valve seat 214 in mutual flat face abutment therebetween provides a fast, reliable and wear-resistant mode of operation for quick shut-off of fuel flow to main nozzle 64 during the lean-out test phase of the automatic A/F adjustment strategy incorporated into the control components in control housing 150. Quick fuel shut-off by this poppet valve action causes a faster lean-out, and hence shorter duration of each test phase, thereby enabling the automatic circuitry to perform its step adjustment function through control driving unit 250 in a shorter operational cycle. Hence the short engine slow down test periods inherent in such on automatic systems operating with engine speed as the input parameter are less noticeable to the appliance operator.

In one working exemplary embodiment of carburetor 50, solenoid 172 and associated poppet valve 96 are constructed in accordance with the following parameters:

| | |
|---|---|
| Minimum cycle duration of opening and closing of valve 96 | 4 milliseconds/ complete stroke cycle |
| Diameter of disc 210 of valve 96 | 2 mm |
| Diameter of passage 98 of valve insert 214 | 1.4 mm |
| Material valve insert 214 | Bunua N or Viton |
| Total stroke of valve 96 | 0.6 mm |
| Construction of coil 180 | 22.86 meters of 36 gauge magnet wire |

Although specific preferred embodiments of this invention have been shown and described, it will of course now be realized that further variations of the concepts of the invention will occur from the foregoing disclosure to those skilled in the art. For example, the invention is applicable to various automatic control systems that do not use the lean-out test principle. Hence in certain of such applications solenoid 172 and poppet valve 96 can be omitted while retaining the worm gear driven needle 84 as well as other advantageous features of the combinations and sub-combinations of the invention. On the other hand, in certain automatic electric carburetors using control strategies which do not employ electro-mechanical adjustment of the high speed mixture needle 84, driving unit 250 and needle 84 can be omitted, and solenoid 172 and associated poppet valve 96 rendered operable by pulse width modulation control systems and the like to perform both the testing lean-out phase as well as sole control of fuel flow to venturi passage 54 to thereby adjust A/F in accordance with the selected engine operational parameter employed in such system strategy. Also, as indicated previously, the choke/throttle lock-out systems of the invention can be advantageously applied to standard non-automatic float or diaphragm carburetors requiring manual operation of the choke and throttle controls by the appliance operator as is customarily required in the small engine appliance field. Therefore, the invention should not be considered limited to the preferred embodiments described above and/or as shown in drawings, but can be modified in various ways within the scope of the appended claims.

It is also to be understood that orientation terminology, such as "top", "bottom", "front", "rear", etc. as employed in the foregoing description and appended claims is used to facilitate description and not by way of limitation, it also being understood that the illustrative diaphragm carburetors 50 and 50' are normally operable in all engine orientations in typical appliance use.

What is claimed is:

1. A manually and semi-automatic electrically controlled carburetor having a heat conductive metal body with a mixing passage extending axially and centrally therethrough and opening at opposed end faces of said body, a manually controlled throttle valve disposed in said mixing passage and movable between closed low idle and an wide open throttle positions, a liquid fuel metering chamber, a main fuel nozzle communicating with said metering chamber and said mixing passage upstream of said throttle valve when in said idle position, a manually controlled choke valve disposed in said mixing passage upstream of said main fuel nozzle and movable between a closed cold start and wide open positions, said body having top and bottom generally flat sides disposed generally parallel with one another on opposite sides of said mixing passage, said fuel metering chamber being disposed at said body bottom side and having a diaphragm and an air chamber cover plate associated therewith, electrically adjustable fuel valve means disposed in said body for controlling flow of fuel from said metering chamber to said main fuel nozzle, a heat conductive metal control box housing mounted on said body over said body top side, said housing having a bottom wall juxtaposed to said body top side and housing side wall means upstanding from said housing bottom wall and defining therewith an interior electronic control component compartment, said compartment containing electronic control circuits and associated electronic components operably adapted to actuate said fuel valve means in response an engine operating parameter sensing signal to thereby automatically adjust the air/fuel ratio (A/F) of an engine operably associated with said carburetor, and engine pressure pulse operated diaphragm fuel pump means including flap valve gasket means mounted between said housing bottom wall and said body top side and associated pump fuel feeding passages and pump diaphragm chamber means disposed in both said housing bottom wall and in said body adjacent said body top side such that pump fuel flow through said pump means to said metering chamber is in heat exchange relationship with said housing component compartment and said mixing passage via said housing bottom wall and said body.

2. The carburetor as set forth in claim 1 wherein said housing side wall means includes laterally opposed front and rear walls disposed generally flush with said body front and rear end faces respectively, said body having first and second laterally opposite side walls with a ledge portion projecting outwardly from first side wall beneath said housing bottom wall for supporting said housing asymmetrical oriented with respect to a pair of laterally opposed first and second side walls of said housing such that said housing is skewed toward said first body side wall and centered in laterally offset relation to said passage axis at an acute offset angle therefrom to the body top wall, said body side walls having laterally opposite side surface portions inclined generally parallel to said offset angle, and a throttle valve shaft and a choke valve shaft rotatable mounted in and extending through said body and having their opposite ends protruding exteriorly through said inclined surfaces of said side walls and with their axes oriented at about 90° to said offset angle, first manual choke and throttle mechanical control component means being operably mounted on those of said shaft ends protruding from said first body side wall and being disposed beneath said body ledge exteriorly of said body, the axially oppositely end of said throttle shaft protruding from said inclined surface of said second side wall and carrying second throttle mechanical control component means thereon, and a fuel adjusting drive unit housing mounted on said second side wall adjacent said second mechanical control components to thereby provide a protective protruding structure for the same.

3. The carburetor set forth in claim 1 wherein said automatic fuel adjusting means includes an electric solenoid means mounted in said housing component compartment and said fuel valve means is disposed therebeneath in the top side of said carburetor body and operably coupled to said solenoid means.

4. Method of adjusting the air/fuel ratio (A/F) of an i.c. engine provided with a carburetor having an electrically adjustable A/F control system and manually controlled mechanical choke and throttle valve control system and associated main nozzle and idle fuel circuits by means of an electronic detector and control unit to which current is supplied by an ignition magnet or generator and which comprises a tachometer, data processing means, an electronic memory, and a control unit for adjusting said ratio, the first derivative of the speed of revolution being used as a parameter for the adjustment, and the adjustment is performed after a period of time during which the speed of the engine has been generally constant, and that generally constant speed is detected by calculating the average value of said derivative, such that the speed of revolution of the engine is considered to be generally constant when said average value is approximately zero and wherein the air/fuel ratio is adjusted stepwise or successively when the engine is operating under load, until said first derivative (speed variations) has reached a predetermined level, or a break point of lean adjustment is detected, said method comprising the steps of:

(a) preventing motion of the choke valve from wide open position anywhere when the throttle valve is positioned between approximately fast idle to wide open positions, and (b) shutting off fuel flow to the idle circuit when the throttle valve is positioned beyond fast idle to full open positions.

5. Method according to claim 4 characterized in that the air/fuel ratio is adjusted stepwise or successively when the engine is operating under load until the limit of lean adjustment has been determined as a function of a reduction of speed of revolution of the engine.

6. A carburetor having a mixing passage, a throttle valve disposed in said mixing passage and movable between a low idle position and an wide open throttle position, a liquid fuel metering chamber, a main fuel nozzle communicating with said metering chamber and said mixing passage upstream of said throttle valve, at least one idle fuel port communicating with said mixing passage downstream of said throttle valve, means for controlling said carburetor adapted when in operable association with an internal combustion engine to automatically adjust the air/fuel ratio (A/F) thereof to a preferred value, said control means comprising electronic control circuit means and valve means for adjusting the A/F by controlling flow to said main fuel nozzle in response to an actuating signal output of said control circuit means, and idle fuel port shut-off means operably connected to said throttle valve to close fuel supply to said idle port in response to initial movement of said throttle valve from fast idle position toward wide open position and vice versa, and wherein said adjustment valve means comprises a poppet valve actuated by a solenoid to move between an open position allowing total fuel flow to said main fuel nozzle of said carburetor from said metering chamber, and a closed position interrupting said total flow to change the A/F to a leaner mixture for a short period of time.

7. The carburetor as set forth in claim 6 wherein said adjusting means is proportionally actuated by said signal output of said control circuit means to adjust the A/F.

8. The carburetor as set forth in claim 7 wherein said adjusting valve means is constructed and arranged to be operable to provide the sole adjustment for controllably adjusting the A/F.

9. The carburetor as set forth in claim 6 wherein said adjusting means also comprises a fuel needle which is continuously axially movable as required to serially control total fuel flow, via said poppet valve when open, to said main nozzle and thereby adjust the A/F.

10. The carburetor as set forth in claim 9 wherein said adjusting means further comprises an electric motor and worm gear drive unit operably mechanically coupled to said fuel needle for rotatably threading the same in said carburetor to produce said axial movement thereof.

11. The carburetor as set forth in claim 6 wherein said idle fuel port shut-off means comprises an idle fuel shut-off assembly comprising, a valve chamber, an inlet to said valve chamber communicating with said fuel metering chamber, an outlet from said valve chamber communicating with said at least one idle port, a valve member received in said valve chamber and operable for movement to open and closed positions to control admission of fuel from said metering chamber into said valve chamber, and an actuator operably connecting said throttle valve with said valve member so that as said throttle valve moves from its fast idle position to its wide open throttle position, said valve member is closed, and when said throttle is moved back to its fast idle position said valve member is moved to its open position to supply fuel from said metering chamber through said valve chamber and to said at least one idle port for idling the engine.

12. A carburetor having a mixing passage, a throttle valve disposed in said mixing passage and movable between a low idle position and an wide open throttle position, a liquid fuel metering chamber, a main fuel nozzle communicating with said metering chamber and said mixing passage upstream of said throttle valve, means biasing said throttle valve towards the low idle position, a first control lever operable to pivotally displace said throttle valve between low idle and wide open positions, a choke valve pivotally mounted in said mixing passage upstream of said main fuel nozzle, a second control lever operable to pivotally displace said choke valve between closed start and open rest positions, and cold-start holding means which when actuated by said second control lever moves said throttle valve to a start position via detent means, said detent means being released when said throttle valve is moved from fast idle toward open position to thereby allow said throttle valve to be pivotally displaced between low idle position and wide open position against the biasing force of said spring means, and lock-out means operatively coupled to at least one of said choke and throttle valves and operable to block movement of the other one of said choke and throttle valves when said valves are disposed between predetermined positions in their respective travel ranges between fast idle and wide open positions.

13. The carburetor as set forth in claim 12 wherein said cold start holding means comprises said second control lever and said lock-out means comprises a throttle motion blocking blade operably coupled to said second control lever and pivotal about a rotational axis of said choke valve and operable to block movements of said throttle valve between fast idle and open positions when said choke valve is positioned between open and start positions.

14. The carburetor as set forth in claim 12 wherein said lock-out means comprises a choke motion blocking blade operably coupled to said throttle valve and constructed and arranged relative to said second control lever to prevent pivotal movement of said choke valve between its open and start positions when said throttle valve is disposed between its fast idle start and wide open positions.

15. The carburetor as set forth in claim 12 wherein said cold start holding means comprises said second control lever and said lock-out means comprises a throttle motion blocking blade operably coupled to said second control lever and pivotal about a rotational axis of said choke valve and operable to block movements of said throttle valve between fast idle and open positions when said choke valve is positioned between open and start positions, and wherein said lock-out means comprises a choke motion blocking blade operably coupled to said throttle valve and constructed and arranged relative to said second control lever to prevent pivotal movement of said choke valve between its open and start positions when said throttle valve is disposed between its fast idle start and wide positions, and wherein said throttle motion blocking blade and said choke motion blocking blade are constructed and arranged to travel in coplanar travel planes and have mutually partially interfering travel paths, said blocking blades having blocking edge contours constructed and arranged to perform said mutually blocking functions in the mutually interfering portions of their travel paths.

16. The carburetor as set forth in claim 15 wherein said choke and throttle valves are operable in the same rotary direction between their respective open and closed positions, wherein said throttle motion blocking blade comprises an integral coplanar extension of said second control lever and said second control lever is operably coupled to said choke valve for pivotal motion therewith, said detent means including releasably first catch means on said second control lever, and wherein said choke motion blocking blade comprises an integral extension of said first control lever, said first control lever being operably coupled to said throttle valve for pivotal motion therewith, said detent means including releasably second catch means on said first control lever cooperable with said first catch means to perform as said cold-start holding means.

17. The carburetor as set forth in claim 16 wherein said blades each comprise pie-shaped segments having radially extending leading and trailing edges and an arcuate free blocking edge extending therebetween.

18. The carburetor as set forth in claim 17 wherein said first control lever has an arm extending generally diametrically oppositely from said choke blocking blade thereof and carrying said second catch means on the free end thereof.

19. The carburetor as set forth in claim 15 wherein said choke and throttle valves are operable in opposite rotary directions between their respective open and closed positions, wherein said throttle blocking blade comprises an integral extension of said second control lever and said second control lever is operably coupled to said choke valve for pivotal motion therewith, and wherein said choke motion blocking blade comprises an auxiliary lever rotatable about the rotational axis of said first control lever adjacent thereto, and cooperable spring and stop means operable coupling said auxiliary lever to said first control member for releasably holding said auxiliary member in a first angular position relative to said first control lever in blocking relation to said throttle blocking blade when said throttle valve is disposed between its fast idle start and wide open positions, said throttle blocking blade being operable to engage said auxiliary lever when said throttle valve is positioned between low and fast idle positions for causing pivotal movement of said auxiliary lever to a second angular position relative to said first control lever wherein said throttle blocking blade and said spring and stop means cooperate to block motion of said throttle valve generally beyond fast idle position toward wide open position.

20. A carburetor having a mixing passage, a throttle valve disposed in said mixing passage and movable between a low idle position and an wide open throttle position, a liquid fuel metering chamber, a main fuel nozzle communicating with said metering chamber and said mixing passage upstream of said throttle valve when in said idle position, at least one idle fuel port communicating with said mixing passage downstream of said throttle valve when in its closed idle position, means for controlling said carburetor adapted when in operable association with an internal combustion engine to automatically adjust the air-to-fuel ratio (A/F) thereof to a preferred value, said means comprising first and second control circuits and means for adjusting the A/F by controlling flow to said main fuel nozzle, a first control unit of said first control circuit for actuating said adjusting means in response to a signal output of said first control circuit to generally continuously adjust the A/F to provide a modified relation of A/F to a speed of rotation of said engine, a second control unit of said second control circuit for actuating said adjusting means in response to a signal output of said second control circuit to periodically change A/F to a different level for a short period of time and adjust A/F a predetermined step toward said preferred value, wherein said second control unit receives a signal corresponding to said speed of rotation, and idle fuel port shut-off means operably connected to said throttle valve to close fuel supply to said idle port in response to initial movement of said throttle valve from fast idle position toward wide open position and vice versa, and wherein said adjustment means comprises a poppet valve actuated by a solenoid under control of said second control circuit to rapidly move between an open position allowing total fuel flow to said main fuel nozzle of said carburetor from said metering chamber, and rapidly to a closed position interrupting said total flow to stepwise change A/F to a leaner mixture for said short period of time.

21. The carburetor as set forth in claim 20 wherein said poppet valve of said adjusting means is also operable by pulse width modulation control by said first control circuit to thereby provide the sole adjustment valve means for controllably periodically test interrupting fuel flow and also continuously adjusting the A/F.

22. The carburetor as set forth in claim 20 wherein said adjusting means is also operable to provide the sole adjustment valve means for controllably adjusting the A/F.

23. A carburetor having a mixing passage, a throttle valve disposed in said mixing passage and movable between a low idle position and an wide open throttle position, a liquid fuel metering chamber, a main fuel nozzle communicating with said metering chamber and said mixing passage upstream of said throttle valve when in said idle position, at least one idle fuel port communicating with said mixing passage downstream of said throttle valve when in its closed idle position, means for controlling said carburetor adapted when in operable association with an internal combustion engine to automatically adjust the air-to-fuel ratio (A/F) thereof to a preferred value, said means comprising first and second control circuits and means for adjusting the A/F by controlling flow to said main fuel nozzle, a first control unit of said first control circuit for actuating said adjusting means in response to a signal output of said first control circuit to generally continuously adjust the A/F to provide a modified relation of A/F to a speed of rotation of said engine, a second control unit of said second control circuit for actuating said adjusting means in response to a signal output of said second control circuit to periodically change A/F to a different level for a short period of time and adjust A/F a predetermined step toward said preferred value, wherein said second control unit receives a signal corresponding to said speed of rotation, and idle fuel port shut-off means operably connected to said throttle valve to close fuel supply to said idle port in response to initial movement of said throttle valve from fast idle position toward wide open position and vice versa, and wherein said adjusting means comprises a fuel needle which is continuously axially movable to control total fuel flow to said main nozzle and thereby adjust A/F, wherein said adjusting means further comprises an electric motor and worm gear drive unit operably mechanically coupled to said fuel needle for rotatably threading the same in said carburetor to produce said axial movement thereof, and wherein said drive unit is detachably mounted to said carburetor and includes an output drive shaft means axially engageable with and detachably coupled to said fuel needle.

24. The carburetor set forth in claim 23 wherein said drive unit comprises a housing comprising first and second elongated cup like members assembled to one another along a planar parting line extending longitudinally of said housing and said members, said members is assembly defining a motor compartment and a worm gear drive compartment coaxially aligned parallel to said parting line plane, said electric motor and said worm gear drive being received respectively in said motor and drive compartments, said drive unit including a helical gear meshing with a worm gear, said helical gear being oriented with its rotational axis perpendicular to said plane and having an output shaft extending exteriorly from said housing for said operable coupling to said fuel needle, said worm and helical gear having a self-locking gear reduction ratio operable to provide self-braking action in the off-condition of said motor.

25. The carburetor as set forth in claim 24 wherein said motor and worm gear comprise a rigidly interconnected subassembly having axial oppositely protruding end mount means, said housing members having static structural means cooperative with said end mount means for securing said motor against rotation in said housing and journally said worm gear for rotation by said motor in said housing upon assembly of said members together at said parting line.

26. A carburetor having a mixing passage, a throttle valve disposed in said mixing passage and movable between a low idle position and an wide open throttle position, a liquid fuel metering chamber, a main fuel nozzle communicating with said metering chamber and said mixing passage upstream of said throttle valve when in said idle position, at least one idle fuel port communicating with said mixing passage downstream of said throttle valve when in its closed idle position, means for controlling said carburetor adapted when in operable association with an internal combustion engine to automatically adjust the air-to-fuel ratio (A/F) thereof to a preferred value, said means comprising first and second control circuits and means for adjusting the A/F by controlling flow to said main fuel nozzle, a first control unit of said first control circuit for actuating said adjusting means in response to a signal output of said first control circuit to generally continuously adjust the A/F to provide a modified relation of A/F to a speed of rotation of said engine, a second control unit of said second control circuit for actuating said adjusting means in response to a signal output of said second control circuit to periodically change A/F to a different level for a short period of time and adjust A/F a predetermined step toward said preferred value, wherein said second control unit receives a signal corresponding to said speed of rotation, and idle fuel port shut-off means operably connected to said throttle valve to close fuel supply to said idle port in response to initial movement of said throttle valve from fast idle position toward wide open position and vice versa, and further including spring means biasing said throttle valve towards the low idle position, a first control lever operable to pivotally displace said throttle valve between low idle and wide open positions, a choke valve pivotally mounted in said mixing passage upstream of said main fuel nozzle, a second control lever operable to pivotally displace said choke valve between closed start and open rest positions, and cold-start holding means which when actuated by said second control lever moves said throttle valve to a fast idle start position via detent means, said detent means being released by said first control lever when said throttle valve is moved from fast idle start toward full open position to thereby allow said throttle valve to be pivotally displaced toward low idle position from fast idle start position under the action of said spring means and said first control lever, and lock-out means operatively coupled to at least one of said choke and throttle valves and operable to block movement of the other one of said choke and throttle valves when said valves are disposed between predetermined positions in their respective travel ranges between start and wide open positions.

27. The carburetor as set forth in claim 26 wherein said cold start holding means comprises said second control lever and said lock-out means comprises a throttle motion blocking blade operably coupled to said second control lever and pivotal about a rotational axis of said choke valve and operable to block movement of said throttle valve between start and open positions when said choke valve is positioned between open and start positions.

28. The carburetor as set forth in claim 26 wherein said lock-out means comprises a choke motion blocking blade operably coupled to said throttle valve and constructed and arranged relative to said second control member to prevent pivotal movement of said choke valve between its open and start positions when said throttle valve is disposed between its start and wide open positions.

29. The carburetor as set forth in claim 26 wherein said cold start holding means comprises said second control lever and said lock-out means comprises a throttle motion blocking blade operably coupled to said second control lever and pivotal about a rotational axis of said choke valve and operable to block movement of said throttle valve between start and open positions when said choke valve is positioned between open and start positions, and wherein said lock-out means comprises a choke motion blocking blade operably coupled to said throttle valve and constructed and arranged relative to said second control member to prevent pivotal movement of said choke valve between its open and start positions when said throttle valve is disposed between its start and wide open positions, and wherein said throttle motion blocking blade and said choke motion blocking blade are constructed and arranged to travel in coplanar travel planes and have mutually partially interfering travel paths, said blocking blades having blocking edge contours constructed and arranged to perform said mutually blocking functions in the mutually interfering portions of their travel paths.

30. Method of adjusting the air/fuel ratio (A/F) of an i.c. engine provided with a carburetor having an electrically adjustable A/F control system and manually controlled mechanical choke and throttle valve control system and associated main nozzle and idle fuel circuits by means of an electronic detector and control unit to which current is supplied by an ignition magnet or generator and which comprises a tachometer, data processing means, an electronic memory, and a control unit for adjusting said ratio, the first derivative of the speed of revolution being used as a parameter for the adjustment, and the adjustment is performed after a period of time during which the speed of the engine has been generally constant, and that generally constant speed is detected by calculating the average value of said derivative, such that the speed of revolution of the engine is considered to be generally constant when said average value is approximately zero and wherein the air/fuel ratio is adjusted stepwise or successively when the engine is operating under load, until said first derivative (speed variations) has reached a predetermined level, or a break point of lean adjustment is detected, said method comprising the steps of:

(a) preventing motion of the choke valve from wide open position when the throttle valve is positioned between approximately fast idle to wide open positions, (b) shutting off fuel flow to the idle circuit when the throttle valve is positioned beyond fast idle to full open positions, (c) adjusting the air/fuel ratio stepwise or successively when the engine is operating under load until the limit of lean adjustment has been determined as a function of a reduction of speed of revolution of the engine, and (d) performing said adjustment of the air/fuel ratio by momentarily shutting off all fuel flow to the main nozzle while fuel flow to the idle circuit remains shut-off.

31. The method as set forth in claim 30 wherein the momentary shut off step is performed by opening and closing a solenoid operated poppet valve provided in serial fuel flow controlling relationship to the main nozzle.

32. The method as set forth in claim 31 wherein the solenoid poppet valve is constructed, arranged and operated to provide the sole means for adjusting the air/fuel ratio by varying the opening and closing cycle of the poppet valve.

33. A carburetor having a mixing passage, a throttle valve disposed in said mixing passage and movable between a low idle position and an wide open throttle position, a liquid fuel metering chamber, a main fuel nozzle communicating with said metering chamber and said mixing passage upstream of said throttle valve, at least one idle fuel port communicating with said mixing passage downstream of said throttle valve, means for controlling said carburetor adapted when in operable association with an internal combustion engine to automatically adjust the air/fuel ratio (A/F) thereof to a preferred value, said control means comprising electronic control circuit means and valve means for adjusting the A/F by controlling flow to said main fuel nozzle in response to an actuating signal output of said control circuit means, and idle fuel port shut-off means operably connected to said throttle valve to close fuel supply to said idle port in response to initial movement of said throttle valve from fast idle position toward wide open position and vice versa, and wherein said valve means comprises a fuel needle which is continuously axially movable to control total fuel flow to said main nozzle and thereby adjust the A/F, and an electric motor and worm gear drive unit operably mechanically coupled to said fuel needle for rotatably threading the same in said carburetor to produce said axial movement thereof, and wherein said drive unit is detachably mounted to said carburetor and includes an output drive shaft means axially engageable with and detachably coupled to said fuel needle.

34. The carburetor set forth in claim 33 wherein said worm gear drive unit has a self-locking gear reduction ratio operable to provide self-braking action in the off-condition of said motor.

35. A carburetor having a mixing passage, a throttle valve disposed in said mixing passage and movable between a low idle position and an wide open throttle position, a liquid fuel metering chamber, a main fuel nozzle communicating with said metering chamber and said mixing passage upstream of said throttle valve, at least one idle fuel port communicating with said mixing passage downstream of said throttle valve, means for controlling said carburetor adapted when in operable association with an internal combustion engine to automatically adjust the air/fuel ratio (A/F) thereof to a preferred value, said control means comprising electronic control circuit means and valve means for adjusting the A/F by controlling flow to said main fuel nozzle in response to an actuating signal output of said control circuit means, and idle fuel port shut-off means operably connected to said throttle valve to close fuel supply to said idle port in response to initial movement of said throttle valve from fast idle position toward wide open position and vice versa, spring means biasing said throttle valve towards the low idle position, a first control lever operable to pivotally displace said throttle valve between low idle and wide open positions, a choke valve pivotally mounted in said mixing passage upstream of said main fuel nozzle, a second control lever operable to pivotally displace said choke valve between closed start and open rest positions, and cold-start holding means which when actuated by said second control lever moves said throttle valve to a fast idle start position via detent means, said detent means being released by said first control lever when said throttle valve is moved from first idle start toward full open position to thereby allow said throttle valve to be pivotally displaced toward low idle position from fast idle start position under the action of said spring means and said first control lever, and lock-out means operatively coupled to at least one of said choke and throttle valves and operable to block movement of the other one of said choke and throttle valves when said valves are disposed between predetermined positions in their travel ranges between start and wide open positions.

36. The carburetor as set forth in claim 35 wherein said cold start holding means comprises said second control lever and said lock-out means comprises a throttle motion blocking blade operably coupled to said second control lever and pivotal about a rotational axis of said choke valve and operable to block movement of said throttle valve between start and open positions when said choke valve is positioned between open and start positions.

37. The carburetor as set forth in claim 35 wherein said lock-out means comprises a choke motion blocking blade operably coupled to said throttle valve and constructed and arranged relative to said second control member to prevent pivotal movement of said choke valve between its open and start positions when said throttle valve is disposed between its start and wide open positions.

38. The carburetor as set forth in claim 35 wherein said cold start holding means comprises said control control lever and said lock-out means comprises a throttle motion blocking blade operably coupled to said second control lever and pivotal about a rotational axis of said choke valve and operable to block movement of said throttle valve between start and open positions when said choke valve is positioned between open and start positions, and wherein said lock-out means comprises a choke motion blocking blade operably coupled to said throttle valve and constructed and arranged relative to said second control member to prevent pivotal movement of said choke valve between its open and start positions when said throttle valve is disposed between its start and wide open positions, and wherein said throttle motion blocking blade and said choke motion blocking blade are constructed and arranged to travel in coplanar travel planes and have mutually partially interfering travel paths, said blocking blades having blocking edge contours constructed and arranged to perform said mutual blocking functions in the mutually interfering portions of their travel paths.

39. A carburetor having a mixing passage, a throttle valve disposed in said mixing passage and movable between a low idle position and an wide open throttle position, a liquid fuel metering chamber, a main fuel nozzle communicating with said metering chamber and said mixing passage upstream of said throttle valve, at least one idle fuel port communicating with said mixing passage downstream of said throttle valve when in its closed idle position, means for controlling said carburetor adapted when in operable association with an internal combustion engine to automatically adjust the air-to-fuel ratio (A/F) thereof to a preferred value, said controlling means comprising first and second control circuits and means for adjusting the A/F by controlling flow to said main fuel nozzle, a first control unit of said first control circuit for actuating said adjusting means in response to a signal output of said first control circuit to generally continuously adjust the A/F to provide a modified relation of A/F to a speed of rotation of said engine, a second control unit of said second control circuit for actuating said adjusting means in response to a signal output of said second control circuit to periodically change A/F to a different level for a short period of time and adjust A/F a predetermined step toward said preferred value, wherein said second control unit receives a signal corresponding to said speed of rotation, said adjustment means comprising a solenoid operably coupled to said second control circuit and a poppet valve actuated by said solenoid to move between an open position allowing total fuel flow to said main fuel nozzle of said carburetor from said metering chamber, and a closed position interrupting said total flow to change A/F to a leaner mixture for said short period of time, and needle drive means operably coupled to said first control circuit and a fuel needle in upstream flow relation to said poppet valve when open and which is continuously axially movable by said needle drive means to control total fuel flow to said main nozzle via said poppet valve and thereby adjust A/F, and wherein said A/F controlling means is operable to control said first and second control circuits such that said needle drive means and said solenoid are not actuated at the same time in performing their respective A/F adjustment and lean-out test functions to thereby reduce total power requirements in the automatic mode of operation of said carburetor by said A/F controlling means.

40. A carburetor having a mixing passage, a throttle valve disposed in said mixing passage and movable between a low idle position and an wide open throttle position, a liquid fuel metering chamber, a main fuel nozzle communicating with said metering chamber and said mixing passage upstream of said throttle valve, at least one idle fuel port communicating with said mixing passage downstream of said throttle valve when in its closed idle position, means for controlling said carburetor adapted when in operable association with an internal combustion engine to automatically adjust the air-to-fuel ratio (A/F) thereof to a preferred value, said means comprising first and second control circuits and means for adjusting the A/F by controlling flow to said main fuel nozzle, a first control unit of said first control circuit for actuating said adjusting means in response to a signal output of said first control circuit to generally continuously adjust the A/F to provide a modified relation of A/F to a speed of rotation of said engine, a second control unit of said second control circuit for actuating said adjusting means in response to a signal output of said second control circuit to periodically change A/F to a different level for a short period of time and adjust A/F a predetermined step toward said preferred value, wherein said second control unit receives a signal corresponding to said speed of rotation, and wherein said adjustment means comprises a solenoid operably coupled to said second control circuit and a poppet valve actuated by said solenoid to rapidly move between an open position allowing total fuel flow to said main fuel nozzle of said carburetor from said metering chamber, and to rapidly move to a closed position interrupting said total flow to change A/F to a leaner mixture for said short period of time, said poppet valve also being constructed and arranged between said metering chamber and said main fuel nozzle to be operable by pulse width modulation control of said solenoid by said first control circuit to thereby provide the sole adjustment valve means for controllably continuously and stepwise adjusting the A/F, said solenoid comprising an armature member reciprocable in a path of travel along an axis of said solenoid, and an armature core and an associated coil winding encircling said armature member, said poppet valve comprising a valve member fixedly carried on one end of said armature member and movable in a valve fuel chamber flow communicating with said metering chamber, said valve member having a generally planar valve sealing end face oriented perpendicular to said armature member axis, and an annular valve seat member having a flow passage extending axially therethrough and having an outlet end flow communicating with said main fuel nozzle and an inlet end flow communicating with said valve fuel chamber, said valve seat member having a generally planar sealing surface surrounding said inlet end of said seat member flow passage and exposed in said valve fuel chamber for flow-sealing abutment with said end face of said valve member when said valve member is moved to one end limit of travel with said armature member toward said valve seat member to thereby provide the closed position of said poppet valve.

41. A carburetor having a mixing passage, a throttle valve disposed in said mixing passage and movable between a low idle position and an wide open throttle position, a liquid fuel metering chamber, a main fuel nozzle communicating with said metering chamber and said mixing passage upstream of said throttle valve, at least one idle fuel port communicating with said mixing passage downstream of said throttle valve, means for controlling said carburetor adapted when in operable association with an internal combustion engine to automatically adjust the air/fuel ratio (A/F) thereof to a preferred value, said control means comprising electronic control circuit means and valve means for adjusting the A/F by controlling flow to said main fuel nozzle in response to an actuating signal output of said control circuit means, and further including spring means biasing said throttle valve towards the low idle position, a first control lever operable to pivotally displace said throttle valve between low idle and wide open positions, a choke valve pivotally mounted in said mixing passage upstream of said main fuel nozzle, a second control lever operable to pivotally displace said choke valve between closed start and open rest positions, and cold-start holding means which when actuated by said second control lever moves said throttle valve to a fast idle start position via detent means, said detent means being released by said first control lever when said throttle valve is moved from fast idle start toward full open position to thereby allow said throttle valve to be pivotally displaced toward low idle position from fast idle start position under the action of said spring means and said first control lever, and lock-out means operatively coupled to said choke and throttle valves and operable to block movement of said choke and throttle valves when said valves are disposed between predetermined positions in their respective travel ranges between start and wide open positions, said cold start holding means comprising said second control lever and said lock-out means comprising a throttle motion blocking blade operably coupled to said second control lever and pivotal about a rotational axis of said choke valve and operable to block movement of said throttle valve between start and open positions when said choke valve is positioned between open and start positions, and a choke motion blocking blade operably coupled to said throttle valve and constructed and arranged relative to said second control member to prevent pivotal movement of said choke valve between its open and start positions when said throttle valve is disposed between its start and wide open positions.

42. A carburetor having a mixing passage, a throttle valve disposed in said mixing passage and movable between a low idle position and an wide open throttle position, a liquid fuel metering chamber, a main fuel nozzle communicating with said metering chamber and said mixing passage upstream of said throttle valve, at least one idle fuel port communicating with said mixing passage downstream of said throttle valve, means for controlling said carburetor adapted when in operable association with an internal combustion engine to automatically adjust the air/fuel ratio (A/F) thereof to a preferred value, said control means comprising electronic control circuit means and valve means for adjusting the A/F by controlling flow to said main fuel nozzle in response to an actuating signal output of said control circuit means, and wherein said valve means comprises a fuel needle which is continuously axially movable to control total fuel flow to said main nozzle and thereby adjust the A/F, and an electric motor and worm gear drive unit operably mechanically coupled to said fuel needle for rotatably threading the same in said carburetor to produce said axial movement thereof, and wherein said drive unit is detachably mounted to said carburetor and includes an output drive shaft means axially engageable with and detachably coupled to said fuel needle.

43. The carburetor set forth in claim 42 wherein said drive unit comprises a housing comprising first and second elongated cup like members assembled to one another along a planar parting line extending longitudinally of said housing and said members, said members in assembly defining a motor compartment and a worm gear drive compartment coaxially aligned parallel to said parting line plane, said electric motor and said worm gear drive being received respectively in said motor and drive compartments, said drive unit including a helical gear meshing with a worm gear, said helical gear being oriented with its rotational axis perpendicular to said plane and having an output shaft extending exteriorly from said housing for said operable coupling to said fuel needle, said worm and helical gears having a self-locking gear reduction ratio operable to provide self-braking action in the off-condition of said motor.

44. The carburetor as set forth in claim 43 wherein said motor and worm gear comprise a rigidly interconnected subassembly having axially oppositely protruding end mount means, said housing members having static structural means cooperative with said end mount means for securing said motor against rotation in said housing and journally said worm gear for rotation by said motor in said housing upon assembly of said members together at said parting line.

45. A manually and semi-automatic electrically controlled carburetor having a heat conductive light metal body with a mixing passage extending axially and centrally therethrough and opening at opposed end faces of said body, a manually controlled throttle valve disposed in said mixing passage and movable between closed low idle and an wide open throttle positions, a liquid fuel metering chamber, a main fuel nozzle communicating with said metering chamber and said mixing passage upstream of said throttle valve, a manually controlled choke valve disposed in said mixing passage upstream of said main fuel nozzle and movable between a closed cold start and wide open positions, said body having top and bottom generally flat sides disposed generally parallel with one another on opposite sides of said mixing passage, electrically adjustable fuel valve means disposed in said body for controlling flow of fuel from said metering chamber to said main fuel nozzle, a heat conductive light metal control box housing mounted on said body over said body top side, said housing having a bottom wall juxtaposed to said body top side and having housing side wall means upstanding from said housing bottom wall and defining therewith an interior electronic control component compartment, said compartment containing electronic control circuits and associated electronic components operably adapted to actuate said fuel valve means in response an engine operating parameter sensing signal to thereby automatically adjust the air/fuel ratio (A/F) of an engine operably associated with said carburetor, said automatic fuel adjusting means including an electric solenoid means mounted in said housing component compartment, said fuel valve means being disposed therebeneath in the top side of said carburetor body and operably coupled to said solenoid means, and engine pressure pulse operated fuel feeding pump and metering means and associated fuel feeding passages disposed in both said housing bottom wall and in said body adjacent said body top side such that pump fuel flow through fuel feeding pump and metering means is in heat exchange relationship with said solenoid means and said mixing passage via said body and said housing.

* * * * *

UNITED STATES PATENT AND TRADEMARK OFFICE

CERTIFICATE OF CORRECTION

PATENT NO. : 5,611,312

DATED : March 18, 1997

INVENTOR(S) : Mark S. Swanson and Eric L. King

It is certified that error appears in the above-indentified patent and that said Letters Patent is hereby corrected as shown below:

Col 26, Line 38, change "an" to "a".

Col 26, Line 60, after "response" insert "to".

Col 27, Line 28, change "oppositely" to "opposite".

Col 28, Line 8, change "an" to "a".

Col 28, Line 65, change "an" to "a".

Col 30, Line 9, change "oppositely" to "opposite".

Col 30, Line 37, change "an" to "a".

Col 31, Line 14, change "an" to "a".

Col 31, Line 63, change "gear" to "gears".

Col 32, Line 9, change "an" to "a".

Col 34, Line 3, change "an" to "a".

Col 34, Line 34, change "an" to "a".

Col 35, Line 41, change "an" to "a".

Col 36, Line 17, change "an" to "a".

Col 37, Line 6, change "an" to "a".

Col 38, Line 25, change "journally" to "journalling".

Col 38, Line 33, change "an" to "a".

UNITED STATES PATENT AND TRADEMARK OFFICE

CERTIFICATE OF CORRECTION

PATENT NO. : 5,611,312

DATED : March 18, 1997

INVENTOR(S) : Mark S. Swanson and Eric L. King

It is certified that error appears in the above-indentified patent and that said Letters Patent is hereby corrected as shown below:

Col 38, Line 52, after "response" insert "to".

Signed and Sealed this

Fifteenth Day of July, 1997

Bruce Lehman

*Attest:*

BRUCE LEHMAN

*Attesting Officer*

*Commissioner of Patents and Trademarks*